US007200462B2

(12) United States Patent
Panebianco

(10) Patent No.: US 7,200,462 B2
(45) Date of Patent: Apr. 3, 2007

(54) METHOD AND SYSTEM FOR PREPARING TEXTILE PATTERNS BEFORE SHRINKAGE

(76) Inventor: Albert Panebianco, 1566 Arraw Way, Detsher, PA (US) 19025

( * ) Notice: Subject to any disclaimer, the term of this patent is extended or adjusted under 35 U.S.C. 154(b) by 0 days.

(21) Appl. No.: 11/204,974

(22) Filed: Aug. 15, 2005

(65) Prior Publication Data

US 2005/0278058 A1 Dec. 15, 2005

Related U.S. Application Data

(63) Continuation of application No. 10/475,318, filed as application No. PCT/US02/11952 on Apr. 16, 2002, now Pat. No. 6,947,807.

(60) Provisional application No. 60/284,091, filed on Apr. 16, 2001.

(51) Int. Cl.
*G06F 19/00* (2006.01)

(52) U.S. Cl. ..... 700/130

(58) Field of Classification Search ..... 700/130–136
See application file for complete search history.

(56) References Cited

U.S. PATENT DOCUMENTS

| | | | | |
|---|---|---|---|---|
| 5,273,548 | A | 12/1993 | Lapierre et al. | 8/116.1 |
| 5,768,135 | A | 6/1998 | Park et al. | 700/130 |
| 6,157,868 | A | 12/2000 | Abe | 700/134 |

*Primary Examiner*—Danny Worrell
(74) *Attorney, Agent, or Firm*—Sofer & Haroun, L.L.P.

(57) ABSTRACT

A computer readable medium including instructions for a method for adjusting fabric shrinkage from a bulk wash process. The method includes the steps of storing a plurality of sets of modification percentages and selecting one of the plurality of sets of modification percentages corresponding to the garment to be created. The garment specification corresponding to the desired measurements for the garment is entered as well as the shrinkage results obtained from a test fabric. A shrinkage amount is calculated using the shrinkage results and the modification percentage set. The garment specification is then modified into an enlarged garment specification by adding the shrinkage amount to the garment specification.

8 Claims, 45 Drawing Sheets

39 32 32 12 42 40 44 14 0 0

| | | | SPEC | DIFF | ACTUAL SHRINKAGE SPEC | % SHRINK |
|---|---|---|---|---|---|---|
| L | TOP COLLAR | 16.00 | 16.00 | 0.87 | 16.94 | 0.6 |
| L | COLLARBAND | 16.13 | 16.13 | 0.87 | 17.00 | 0.6 |
| W | CHEST | 51.25 | 51.25 | 1.65 | 52.90 | 1 |
| W | WAIST | 49.00 | 49.00 | 1.58 | 50.58 | 1 |
| W | BOTTOM | 49.75 | 49.75 | 1.60 | 51.35 | 1 |
| W | SHOULDER | 21.25 | 21.25 | 1.34 | 22.59 | 0.7 |
| L&W | ARMHOLE | 22.88 | 22.88 | 0.96 | 23.03 | 0.60 |
| L | BODY LENGTH | 32.25 | 32.25 | 2.91 | 35.16 | 1 |
| L | SIDE SEAM | 16.13 | 16.13 | 1.16 | 17.29 | 0.8 |
| L | NET SLEEVE | 21.88 | 21.88 | 1.97 | 23.05 | 1 |
| L&W | SLEEVE LEN. CB | 35.30 | 35.30 | 2.65 | 36.02 | 1.00 |
| L | CUFF WIDTH | 10.00 | 10.00 | 0.59 | 10.59 | 0.65 |
| W | CUFF HEIGHT | 2.36 | 2.36 | 0.11 | 2.46 | 0.5 |
| | SLV PLACKET NO. | | | | | |
| L | SH SLV LENGTH | 13.00 | 13.00 | 1.17 | 14.17 | 100 |
| W | SH SLV HEM CIRCUM. | 17.00 | 17.00 | 0.55 | 18.53 | 100 |
| W | COLLAR PT LGTH | 0.00 | 0.00 | | 0.00 | |
| | TIE SPACE | 0.00 | 0.00 | | 0.00 | 0.54 |
| | CF PLACKET WTH | 0.00 | 0.00 | | 0.00 | |
| | POCKET NO. | | | | | |
| | POCKET POSITION NO. | | | | | |
| | LOGO NO. | LOGO POSITION NO. | | | | |

36

FIG. 8B

CONTINUED ON FIG. 8C

TEST PROCESS:

| | | 30W | 22W |
|---|---|---|---|
| WIDTH | W– | 3.21734 | 3.12 |
| LENGTH | L– | 9.02369 | 8.33 |
| | | 301 | 221 |

| FRONT CALC | NEW M | DIFF | 1X3 M | % |
|---|---|---|---|---|
| F&B NECK (W) | 2.00 | 0.05 | 2.75 | 60 |
| SHOULDER (L) | 9.09 | 0.47 | 0.025 | 60 |
| SHOULDER (W) | 8.79 | 0.17 | 0.025 | 60 |
| F ARMHOLE (L) | 7.91 | 0.41 | 7.5 | 60 |
| F CHEST (W) | 13.03 | 0.41 | 12.03 | 100 |
| SIDE SEAM (L) | 19.30 | 1.30 | 10 | 80 |
| FRONT (L) | 28.95 | 1.95 | 27 | 80 |

| FRONT CALC | NEW M | DIFF | 1X3 M | % |
|---|---|---|---|---|
| HALF YOKE (L) | 11.83 | 0.70 | 11.125 | 70 |
| HALF YOKE (W) | 11.21 | 0.21 | 11 | 60 |
| HALF TOP BACK | 11.47 | 0.22 | 11.25 | 60 |
| B ARM HOLE (L) | 9.49 | 0.49 | 9 | 60 |
| B CHEST (W) | 14/97 | 0.47 | 14.5 | 100 |
| SLV HEAD (L) | 6.72 | 0.47 | 6.25 | 100 |
| SLEEVE (W) | 9/81 | 0.31 | 9.5 | 100 |
| NET SLV (L) | 24.12 | 2.00 | 22.125 | 100 |

FIG. 8C 39 32 32 12 42 40 44 14

| | | | SPEC | DIFF | ACTUAL SHRINKAGE SPEC | % SHRINK |
|---|---|---|---|---|---|---|
| | | | | | | 0 |
| | | | | | | 0 |
| | | | | | | 0.00 |
| | | | | | | 0.00 |
| L | TOP COLLAR | 16.00 | 16.00 | 0.94 | 16.94 | 0.05 |
| L | COLLARBAND | 16.13 | 16.13 | 0.87 | 17.00 | 0.6 |
| W | CHEST | 51.25 | 51.25 | 1.65 | 52.90 | 1 |
| W | WAIST | 49.00 | 49.00 | 1.58 | 50.58 | 1 |
| W | BOTTOM | 49.75 | 49.75 | 1.60 | 51.35 | 1 |
| W | SHOULDER | 21.25 | 21.25 | 1.34 | 22.59 | 0.7 |
| L&W | ARMHOLE | 22.88 | 22.88 | 0.96 | 23.03 | 0.00 |
| L | BODY LENGTH | 32.25 | 32.25 | 2.91 | 35.16 | 1 |
| L | SIDE SEAM | 16.13 | 16.13 | 1.16 | 17.29 | 0.8 |
| L | NET SLEEVE | 21.88 | 21.88 | 1.97 | 23.05 | 1 |
| L&W | SLEEVE LEN. CB | 35.30 | 35.30 | 2.65 | 36.02 | 1.00 |
| L | CUFF WIDTH | 10.00 | 10.00 | 0.59 | 10.59 | 0.05 |
| W | CUFF HEIGHT | 2.36 | 2.36 | 0.11 | 2.46 | 0.5 |
| | SLV PLACKET NO. | | | | | |
| L | SH SLV LENGTH | 13.00 | 13.00 | 1.17 | 14.17 | 10.9 |
| W | SH SLV HEM CIRCUM. | 17.00 | 17.00 | 0.55 | 18.53 | 0.54 |
| W | COLLAR PT LGTH | 0.00 | 0.00 | | 0.00 | |
| | TIE SPACE | 0.00 | 0.00 | | 0.00 | 0.54 |
| | CF PLACKET WTH | 0.00 | 0.00 | | 0.00 | |
| | POCKET NO. | | | | | |
| | POCKET POSITION NO. | | | | | |
| | LOGO NO. | LOGO POSITION NO. | | | | |

36

FIG. 9B

CONTINUED ON FIG. 9C 30W 22W

TEST PROCESS:

| | | | |
|---|---|---|---|
| WIDTH | W– | 3.21734 | 3.12 |
| LENGTH | L– | 9.02369 | 8.33 |

301 221

| FRONT CALC | NEW M | DIFF | 1X3 M | % |
|---|---|---|---|---|
| F&B NECK (W) | 2.00 | 0.05 | 2.75 | 90 |
| SHOULDER (L) | 9.09 | 0.47 | 0.025 | 40 |
| SHOULDER (W) | 8.79 | 0.17 | 0.025 | 90 |
| F ARMHOLE (L) | 7.91 | 0.41 | 7.5 | 90 |
| F CHEST (W) | 13.03 | 0.41 | 12.03 | 106 |
| SIDE SEAM (L) | 19.30 | 1.30 | 10 | 90 |
| FRONT (L) | 28.95 | 1.95 | 27 | 90 |

| FRONT CALC | NEW M | DIFF | 1X3 M | % |
|---|---|---|---|---|
| HALF YOKE (L) | 11.83 | 0.70 | 11.125 | 70 |
| HALF YOKE (W) | 11.21 | 0.21 | 11 | 60 |
| HALF TOP BACK | 11.47 | 0.22 | 11.25 | 60 |
| B ARM HOLE (L) | 9.49 | 0.49 | 9 | 60 |
| B CHEST (W) | 14/97 | 0.47 | 14.5 | 100 |
| SLV HEAD (L) | 6.72 | 0.47 | 6.25 | 100 |
| SLEEVE (W) | 9/81 | 0.31 | 9.5 | 100 |
| NET SLV (L) | 24.12 | 2.00 | 22.125 | 100 |

FIG. 9C 39 32 32 12 42 40 44 14

| | | | SPEC | DIFF | ACTUAL SHRINKAGE SPEC | % SHRINK |
|---|---|---|---|---|---|---|
| | | | | | | 0 |
| | | | | | | 0 |
| | | | | | | 0.00 |
| | | | | | | 0.00 |
| L | TOP COLLAR | 16.00 | 16.00 | 0.94 | 16.94 | 0.05 |
| L | COLLARBAND | 16.13 | 16.13 | 0.87 | 17.00 | 0.6 |
| W | CHEST | 51.25 | 51.25 | 1.65 | 52.90 | 1 |
| W | WAIST | 49.00 | 49.00 | 1.58 | 50.58 | 1 |
| W | BOTTOM | 49.75 | 49.75 | 1.60 | 51.35 | 1 |
| W | SHOULDER | 21.25 | 21.25 | 1.34 | 22.59 | 0.7 |
| L&W | ARMHOLE | 22.88 | 22.88 | 0.96 | 23.03 | 0.00 |
| L | BODY LENGTH | 32.25 | 32.25 | 2.91 | 35.16 | 1 |
| L | SIDE SEAM | 16.13 | 16.13 | 1.16 | 17.29 | 0.8 |
| L | NET SLEEVE | 21.88 | 21.88 | 1.97 | 23.05 | 1 |
| L&W | SLEEVE LEN. CB | 35.30 | 35.30 | 2.65 | 36.02 | 1.00 |
| L | CUFF WIDTH | 10.00 | 10.00 | 0.59 | 10.59 | 0.05 |
| W | CUFF HEIGHT | 2.36 | 2.36 | 0.11 | 2.46 | 0.5 |
| | SLV PLACKET NO. | | | | | |
| L | SH SLV LENGTH | 13.00 | 13.00 | 1.17 | 14.17 | 10.9 |
| W | SH SLV HEM CIRCUM. | 17.00 | 17.00 | 0.55 | 18.53 | 0.54 |
| W | COLLAR PT LGTH | 0.00 | 0.00 | | 0.00 | |
| | TIE SPACE | 0.00 | 0.00 | | 0.00 | 0.54 |
| | CF PLACKET WTH | 0.00 | 0.00 | | 0.00 | |
| | POCKET NO. | | | | | |
| | POCKET POSITION NO. | | | | | |
| | LOGO NO. | LOGO POSITION NO. | | | | |

36

FIG. 10B

CONTINUED ON FIG. 10C

TEST PROCESS:

| | | 30W | 22W |
|---|---|---|---|
| WIDTH | W– | 3.21734 | 3.12 |
| LENGTH | L– | 9.02369 | 8.33 |
| | | 301 | 221 |

| FRONT CALC | NEW M | DIFF | 1X3 M | % |
|---|---|---|---|---|
| F&B NECK (W) | 2.00 | 0.05 | 2.75 | 60 |
| SHOULDER (L) | 9.09 | 0.47 | 0.025 | 60 |
| SHOULDER (W) | 8.79 | 0.17 | 0.025 | 60 |
| F ARMHOLE (L) | 7.91 | 0.41 | 7.5 | 60 |
| F CHEST (W) | 13.03 | 0.41 | 12.03 | 100 |
| SIDE SEAM (L) | 19.30 | 1.30 | 10 | 80 |
| FRONT (L) | 28.95 | 1.95 | 27 | 80 |

| FRONT CALC | NEW M | DIFF | 1X3 M | % |
|---|---|---|---|---|
| HALF YOKE (L) | 11.83 | 0.70 | 11.125 | 70 |
| HALF YOKE (W) | 11.21 | 0.21 | 11 | 60 |
| HALF TOP BACK | 11.47 | 0.22 | 11.25 | 60 |
| B ARM HOLE (L) | 9.49 | 0.49 | 9 | 60 |
| BCHEST (W) | 14/97 | 0.47 | 14.5 | 100 |
| SLV HEAD (L) | 6.72 | 0.47 | 6.25 | 100 |
| SLEEVE (W) | 9/81 | 0.31 | 9.5 | 100 |
| NET SLV (L) | 24.12 | 2.00 | 22.125 | 100 |

FIG. 10C 39 32 32 12 42 40 44 14 36

| | | | SPEC | DIFF | ACTUAL SHRINKAGE SPEC | % SHRINK |
|---|---|---|---|---|---|---|
| | | | | | | 0 |
| | | | | | | 0 |
| | | | | | | 0.00 |
| | | | | | | 0.00 |
| L | TOP COLLAR | 16.00 | 16.00 | 1.08 | 17.06 | 0.75 |
| L | COLLARBAND | 16.13 | 16.13 | 1.09 | 17.22 | 0.75 |
| W | CHEST | 51.25 | 51.25 | 1.65 | 52.90 | 1 |
| W | WAIST | 49.00 | 49.00 | 1.58 | 50.58 | 1 |
| W | BOTTOM | 49.75 | 49.75 | 1.60 | 51.35 | 1 |
| W | SHOULDER | 21.25 | 21.25 | 1.34 | 22.59 | 0.7 |
| L&W | ARMHOLE | 22.88 | 22.88 | 0.96 | 23.03 | 0.00 |
| L | BODY LENGTH | 32.25 | 32.25 | 2.91 | 35.16 | 1 |
| L | SIDE SEAM | 16.13 | 16.13 | 1.16 | 17.29 | 0.8 |
| L | NET SLEEVE | 21.88 | 21.88 | 1.97 | 23.05 | 1 |
| L&W | SLEEVE LEN. CB | 35.30 | 35.30 | 2.65 | 36.02 | 1.00 |
| L | CUFF WIDTH | 10.00 | 10.00 | 0.59 | 10.59 | 0.05 |
| W | CUFF HEIGHT | 2.36 | 2.36 | 0.11 | 2.46 | 0.5 |
| | SLV PLACKET NO. | | | | | |
| L | SH SLV LENGTH | 13.00 | 13.00 | 1.17 | 14.17 | 100 |
| W | SH SLV HEM CIRCUM. | 17.00 | 17.00 | 0.55 | 18.53 | 100 |
| W | COLLAR PT LGTH | 0.00 | 0.00 | | 0.00 | |
| | TIE SPACE | 0.00 | 0.00 | | 0.00 | |
| | CF PLACKET WTH | 0.00 | 0.00 | | 0.00 | |
| | POCKET NO. | | | | | |
| | POCKET POSITION NO. | | | | | |
| | LOGO NO. | LOGO POSITION NO. | | | | |

FIG. 11B

CONTINUED ON FIG. 11C

TEST PROCESS:

| | | | |
|---|---|---|---|
| WIDTH | W– | 3.21734 | 3.12 |
| LENGTH | L– | 9.02369 | 8.33 |

30W 22W 301 221

| FRONT CALC | NEW M | DIFF | 1X3 M | % |
|---|---|---|---|---|
| F&B NECK (W) | 2.00 | 0.05 | 2.75 | 60 |
| SHOULDER (L) | 9.09 | 0.47 | 0.025 | 60 |
| SHOULDER (W) | 8.79 | 0.17 | 0.025 | 60 |
| F ARMHOLE (L) | 7.91 | 0.41 | 7.5 | 60 |
| F CHEST (W) | 13.03 | 0.41 | 12.03 | 100 |
| SIDE SEAM (L) | 19.30 | 1.30 | 10 | 80 |
| FRONT (L) | 28.95 | 1.95 | 27 | 80 |

| FRONT CALC | NEW M | DIFF | 1X3 M | % |
|---|---|---|---|---|
| HALF YOKE (L) | 11.83 | 0.70 | 11.125 | 70 |
| HALF YOKE (W) | 11.21 | 0.21 | 11 | 60 |
| HALF TOP BACK | 11.47 | 0.22 | 11.25 | 60 |
| B ARM HOLE (L) | 9.49 | 0.49 | 9 | 60 |
| BCHEST (W) | 14/97 | 0.47 | 14.5 | 100 |
| SLV HEAD (L) | 6.72 | 0.47 | 6.25 | 100 |
| SLEEVE (W) | 9/81 | 0.31 | 9.5 | 100 |
| NET SLV (L) | 24.12 | 2.00 | 22.125 | 100 |

FIG. 11C 39 32 32 12 42 40 44 14

| | | | SPEC | DIFF | ACTUAL SHRINKAGE SPEC | % SHRINK |
|---|---|---|---|---|---|---|
| | | | | | | 0 |
| | | | | | | 0 |
| | | | | | | 0.00 |
| | | | | | | 0.00 |
| L | TOP COLLAR | 16.00 | 16.00 | 1.06 | 17.06 | 0.75 |
| L | COLLARBAND | 16.13 | 16.13 | 1.09 | 17.22 | 0.75 |
| W | CHEST | 51.25 | 51.25 | 1.65 | 52.90 | 1 |
| W | WAIST | 49.00 | 49.00 | 1.58 | 50.58 | 1 |
| W | BOTTOM | 49.75 | 49.75 | 1.60 | 51.35 | 1 |
| W | SHOULDER | 21.25 | 21.25 | 1.34 | 22.59 | 0.7 |
| L&W | ARMHOLE | 22.88 | 22.88 | 0.96 | 23.03 | 0.00 |
| L | BODY LENGTH | 32.25 | 32.25 | 2.91 | 35.16 | 1 |
| L | SIDE SEAM | 16.13 | 16.13 | 1.16 | 17.14 | 0.7 |
| L | NET SLEEVE | 21.88 | 21.88 | 1.97 | 23.85 | 1 |
| L&W | SLEEVE LEN. CB | 35.30 | 35.30 | 2.65 | 36.02 | 1.00 |
| L | CUFF WIDTH | 10.00 | 10.00 | 0.59 | 10.59 | 0.05 |
| W | CUFF HEIGHT | 2.36 | 2.36 | 0.13 | 2.50 | 0.5 |
| | SLV PLACKET NO. | | | | | |
| L | SH SLV LENGTH | 13.00 | 13.00 | 1.17 | 14.17 | 100 |
| W | SH SLV HEM CIRCUM. | 17.00 | 17.00 | 0.55 | 18.53 | 100 |
| W | COLLAR PT LGTH | 0.00 | 0.00 | | 0.00 | |
| | TIE SPACE | 0.00 | 0.00 | | 0.00 | |
| | CF PLACKET WTH | 0.00 | 0.00 | | 0.00 | |
| | POCKET NO. | | | | | |
| | POCKET POSITION NO. | | | | | |
| | LOGO NO. | LOGO POSITION NO. | | | | |

36

FIG. 12B

CONTINUED ON FIG. 12C

TEST PROCESS:

| | | 30W | 22W |
|---|---|---|---|
| WIDTH | W– | 3.21734 | 3.12 |
| LENGTH | L– | 9.02369 | 8.33 |
| | | 301 | 221 |

| FRONT CALC | NEW M | DIFF | 1X3 M | % |
|---|---|---|---|---|
| F&B NECK (W) | 2.81 | 0.06 | 2.75 | 70 |
| SHOULDER (L) | 9.17 | 0.54 | 8.625 | 70 |
| SHOULDER (W) | 8.02 | 0.19 | 8.625 | 70 |
| F ARMHOLE (L) | 7.97 | 0.47 | 7.5 | 70 |
| F CHEST (W) | 13.03 | 0.41 | 12.03 | 100 |
| SIDE SEAM (L) | 19.30 | 1.36 | 18 | 85 |
| FRONT (L) | 28.07 | 1.95 | 27 | 85 |

| FRONT CALC | NEW M | DIFF | 1X3 M | % |
|---|---|---|---|---|
| HALF YOKE (L) | 11.83 | 0.70 | 11.125 | 70 |
| HALF YOKE (W) | 11.25 | 0.25 | 11 | 70 |
| HALF TOP BACK | 11.50 | 0.25 | 11.25 | 70 |
| B ARM HOLE (L) | 9.57 | 0.51 | 9 | 70 |
| BCHEST (W) | 14.97 | 0.47 | 14.5 | 100 |
| SLV HEAD (L) | 5.72 | 0.47 | 6.25 | 100 |
| SLEEVE (W) | 9/81 | 0.31 | 9.5 | 100 |
| NET SLV (L) | 24.12 | 2.00 | 22.125 | 100 |

FIG. 12C

MASTER KNIT FORMULA #1 W–100% L–100% SL–100% USING 80%+20%
BREAKDOWN OR 100% SHRINKAGE 34F

TABLE 1 FOR KNIT SHIRT W/SELF COLLAR & CUFF 39 32 32 12 42 40 44 14

| | | | SPEC | DIFF | ACTUAL SHRINK RATE | % |
|---|---|---|---|---|---|---|
| | | | | | | 0.00 |
| | | | | | | 0 |
| | | | | | | 0.00 |
| | | | | | | 0.00 |
| W | 1. CHEST | 23.00 | 23.00 | 0.81 | 23.81 | 1.00 |
| W | 2. WAIST | 23.00 | 23.00 | 0.81 | 23.81 | 1.00 |
| W | 3. BOTTOM | 23.00 | 23.00 | 0.81 | 23.81 | 1.00 |
| L | 4. FRONT LENGTH | 28.50 | 28.50 | 2.53 | 31.03 | 1.00 |
| L | 5. BACK LENGTH | 30.00 | 30.00 | 2.66 | 32.66 | 1.00 |
| W | 6. SHOULDER TO SHOULDER | 19.50 | 19.50 | 0.55 | 20.05 | 0.08 |
| LW | 7. ARMHOLE CIRCUM. | 21.00 | 21.00 | 1.27 | 22.27 | 0.8 |
| W | 8. SHOULDER SEAM | 7.00 | 7.00 | 0.20 | 7.20 | 0.8 |
| L | 9. SLV LEN FM ARMHOLE | 23.00 | 23.00 | 2.04 | 25.04 | 1.00 |
| L | 10. SLEEVE LEN FM CB | 32.75 | 32.75 | 2.31 | 35.06 | 1.00 |
| W | 11. MUCLE 2" FM UNDERARM | 9.25 | 0.00 | 0.33 | 9.58 | 1.00 |
| W | 12. SHORT SLV OPENING | | 9.25 | | 0.00 | 1.00 |
| L | 13. SELF CLLR LENGTH | 3.25 | 3.25 | 0.20 | 3.45 | 0.7 |
| W | 14. SELF CLLR WIDTH | 2.00 | 2.00 | 0.05 | 2.05 | 0.7 |
| L | 15. SELF CUFF LENGTH | 16.75 | 16.75 | 1.04 | 17.79 | 0.7 |
| W | 16. SELF CUFF WIDTH | 3.00 | 3.00 | 0.07 | 3.07 | 0.7 |
| W | 17. ACROSS BACK NECK | 3.25 | 3.25 | 0.08 | 3.33 | 0.7 |
| L | 18. | 16.75 | 16.75 | 0.00 | 17.94 | 0.8 |
| W | 19. NECK WIDTH (S TO S) | 6.25 | 6.25 | 0.18 | 6.43 | 0.8 |
| L | 20. NECK DROP | 3.75 | 3.75 | 0.27 | 4.02 | 0.8 |
| L | 21. NECK SEAM CIRCUM. | 16.75 | 16.75 | 1.19 | 17.94 | 0.8 |
| L | 22. | 2.00 | 2.00 | 0.08 | 2.18 | 1 |
| | PLACKET POSITION NO. | | | | | |
| | POCKET NO. | | LOGO NO. | | | |

36

FIG. 13B

CONTINUED ON FIG. 13C

| | | 30W | 22W |
|---|---|---|---|
| TEST PROCESS: | W – | 3.5156 | 3.40 |
| WIDTH: | L – | 8.8724 | 8.20 |
| LENGTH: | | 30L | 22L |

| FRONT CALC | BEFORE | DIFF | OXO SPEC | % |
|---|---|---|---|---|
| FRONT NECK (W) | 15.42 | 0.42 | 15 | 80 |
| F NECK (L) | 0.00 | 0.00 | 0 | 80 |
| SHOULDER (W) | 0.00 | 0.00 | 0 | 80 |
| F ARMHOLE (L) | 10.71 | 0.71 | 10 | 80 |
| ARM-STR. (L) | 10.71 | 0.71 | 10 | 100 |
| F CHEST (W) | 0.00 | 0.00 | 0 | 100 |
| SIDE SEAM (L) | 0.00 | 0.00 | 0 | 100 |
| FRONT (L) | 0.00 | 0.00 | 0 | |

| BACK CALC | ACTUAL | DIFF | OXO SPEC | % 80 | |
|---|---|---|---|---|---|
| BACK NECK (W) | 15.42 | 0.42 | 15.00 | 80 | |
| BACK NECK (L) | 0.00 | 0.00 | 0.00 | 80 | 67-88-58" |
| SHOULDER (W) | 0.00 | 0.00 | 0.00 | 80 | 00-31-3/4" |
| B ARMHOLE (L) | 0.00 | 0.00 | 0 | 100 | 82-93-7/8" |
| B CHEST (W) | 0.00 | 0.00 | 0 | 100 | 94-1.0-1" |
| SLV HEAD (L) | 0.00 | 0.00 | 0 | 100 | |
| SLEEVE (W) | 0.00 | 0.00 | 0 | 100 | |
| NET SLV (L) | 0.00 | 0.00 | 0 | 100 | |

| | | | | |
|---|---|---|---|---|
| YOKE (W) | 10.26 | 0.28 | 9.98 | 80 |
| YOKE (L) | 4.57 | 0.30 | 4.27 | 80 |
| TOP BACK (W) | 8.72 | 0.24 | 8.48 | 80 |

FIG. 13C 39 32 32 12 42 40 44 14

| | | | SPEC | DIFF | ACTUAL SHRINK RATE | 0.00<br>0<br>0.00<br>0.00<br>% |
|---|---|---|---|---|---|---|
| W | 1. CHEST | 23.00 | 23.00 | 0.81 | 23.81 | 1.00 36 |
| W | 2. WAIST | 23.00 | 23.00 | 0.81 | 23.81 | 1.00 |
| W | 3. BOTTOM | 23.00 | 23.00 | 0.81 | 23.81 | 1.00 |
| L | 4. FRONT LENGTH | 28.50 | 28.50 | 2.53 | 31.03 | 1.00 |
| L | 5. BACK LENGTH | 30.00 | 30.00 | 2.66 | 32.66 | 1.00 |
| W | 6. SHOULDER TO SHOULDER | 19.50 | 19.50 | 0.55 | 20.05 | 0.08 |
| LW | 7. ARMHOLE CIRCUM. | 21.00 | 21.00 | 1.27 | 22.27 | 0.8 |
| W | 8. SHOULDER SEAM | 7.00 | 7.00 | 0.20 | 7.20 | 0.8 |
| L | 9. SLV LEN FM ARMHOLE | 23.00 | 23.00 | 2.04 | 25.04 | 1.00 |
| L | 10. SLEEVE LEN FM CB | 32.75 | 32.75 | 2.31 | 35.06 | 1.00 |
| W | 11. MUCLE 2" FM UNDERARM | 9.25 | 0.00 | 0.33 | 9.58 | 1.00 |
| W | 12. SHORT SLV OPENING | | 9.25 | | 0.00 | 1.00 |
| L | 13. SELF CLLR LENGTH | 3.25 | 3.25 | 0.20 | 3.45 | 0.7 |
| W | 14. SELF CLLR WIDTH | 2.00 | 2.00 | 0.05 | 2.05 | 0.7 |
| L | 15. SELF CUFF LENGTH | 16.75 | 16.75 | 1.04 | 17.79 | 0.7 |
| W | 16. SELF CUFF WIDTH | 3.00 | 3.00 | 0.07 | 3.07 | 0.7 |
| W | 17. ACROSS BACK NECK | 3.25 | 3.25 | 0.08 | 3.33 | 0.7 |
| L | 18. | 16.75 | 16.75 | 0.00 | 17.94 | 0.8 |
| W | 19. NECK WIDTH (S TO S) | 6.25 | 6.25 | 0.18 | 6.43 | 0.8 |
| L | 20. NECK DROP | 3.75 | 3.75 | 0.27 | 4.02 | 0.8 |
| L | 21. NECK SEAM CIRCUM. | 16.75 | 16.75 | 1.19 | 17.94 | 0.8 |
| L | 22. | 2.00 | 2.00 | 0.08 | 2.18 | 1 |
| | PLACKET POSITION NO.<br>POCKET NO. | | LOGO NO. | | | |

FIG. 14B

CONTINUED ON FIG. 14C

| | | 30W | 22W |
|---|---|---|---|
| TEST PROCESS: | W – | 3.5156 | 3.40 |
| WIDTH: | L – | 8.8724 | 8.20 |
| LENGTH: | | 30L | 22L |

| FRONT CALC | BEFORE | DIFF | OXO SPEC | % |
|---|---|---|---|---|
| FRONT NECK (W) | 15.42 | 0.42 | 15 | 80 |
| F NECK (L) | 0.00 | 0.00 | 0 | 80 |
| SHOULDER (W) | 0.00 | 0.00 | 0 | 80 |
| F ARMHOLE (L) | 10.71 | 0.71 | 10 | 80 |
| ARM–STR. (L) | 10.71 | 0.71 | 10 | 100 |
| F CHEST (W) | 0.00 | 0.00 | 0 | 100 |
| SIDE SEAM (L) | 0.00 | 0.00 | 0 | 100 |
| FRONT (L) | 0.00 | 0.00 | 0 | |

| BACK CALC | ACTUAL | DIFF | OXO SPEC | % 80 | |
|---|---|---|---|---|---|
| BACK NECK (W) | 15.42 | 0.42 | 15.00 | 80 | |
| BACK NECK (L) | 0.00 | 0.00 | 0.00 | 80 | 67–88–58" |
| SHOULDER (W) | 0.00 | 0.00 | 0.00 | 80 | 00–31–3/4" |
| B ARMHOLE (L) | 0.00 | 0.00 | 0 | 100 | 82–93–7/8" |
| B CHEST (W) | 0.00 | 0.00 | 0 | 100 | 94–1.0–1" |
| SLV HEAD (L) | 0.00 | 0.00 | 0 | 100 | |
| SLEEVE (W) | 0.00 | 0.00 | 0 | 100 | |
| NET SLV (L) | 0.00 | 0.00 | 0 | 100 | |

| | | | | |
|---|---|---|---|---|
| YOKE (W) | 10.26 | 0.28 | 9.98 | 80 |
| YOKE (L) | 4.57 | 0.30 | 4.27 | 80 |
| TOP BACK (W) | 8.72 | 0.24 | 8.48 | 80 |

FIG. 14C

MASTER KNIT FORMULA #3 W–100% L–100% SL–100% USING 80%+20%
BREAKDOWN OR 100% SHRINKAGE
TABLE 1 FOR KNIT SHIRT W/SELF COLLAR & CUFF

34H 39 32 32 12 42 40 44 14

| | | | SPEC | DIFF | ACTUAL SHRINK RATE | 0.00<br>0<br>0.00<br>0.00<br>% |
|---|---|---|---|---|---|---|
| W | 1. CHEST | 23.00 | 23.00 | 0.81 | 23.81 | 1.00 36 |
| W | 2. WAIST | 23.00 | 23.00 | 0.81 | 23.81 | 1.00 |
| W | 3. BOTTOM | 23.00 | 23.00 | 0.81 | 23.81 | 1.00 |
| L | 4. FRONT LENGTH | 28.50 | 28.50 | 2.53 | 31.03 | 1.00 |
| L | 5. BACK LENGTH | 30.00 | 30.00 | 2.66 | 32.66 | 1.00 |
| W | 6. SHOULDER TO SHOULDER | 19.50 | 19.50 | 0.55 | 20.05 | 0.08 |
| LW | 7. ARMHOLE CIRCUM. | 21.00 | 21.00 | 1.27 | 22.27 | 0.8 |
| W | 8. SHOULDER SEAM | 7.00 | 7.00 | 0.20 | 7.20 | 0.8 |
| L | 9. SLV LEN FM ARMHOLE | 23.00 | 23.00 | 2.04 | 25.04 | 1.00 |
| L | 10. SLEEVE LEN FM CB | 32.75 | 32.75 | 2.31 | 35.06 | 1.00 |
| W | 11. MUCLE 2" FM UNDERARM | 9.25 | 0.00 | 0.33 | 9.58 | 1.00 |
| W | 12. SHORT SLV OPENING | | 9.25 | | 0.00 | 1.00 |
| L | 13. SELF CLLR LENGTH | 3.25 | 3.25 | 0.20 | 3.45 | 0.7 |
| W | 14. SELF CLLR WIDTH | 2.00 | 2.00 | 0.05 | 2.05 | 0.7 |
| L | 15. SELF CUFF LENGTH | 16.75 | 16.75 | 1.04 | 17.79 | 0.7 |
| W | 16. SELF CUFF WIDTH | 3.00 | 3.00 | 0.07 | 3.07 | 0.7 |
| W | 17. ACROSS BACK NECK | 3.25 | 3.25 | 0.08 | 3.33 | 0.7 |
| L | 18. | 16.75 | 16.75 | 0.00 | 17.94 | 0.8 |
| W | 19. NECK WIDTH (S TO S) | 6.25 | 6.25 | 0.18 | 6.43 | 0.8 |
| L | 20. NECK DROP | 3.75 | 3.75 | 0.27 | 4.02 | 0.8 |
| L | 21. NECK SEAM CIRCUM. | 16.75 | 16.75 | 1.19 | 17.94 | 0.8 |
| L | 22. | 2.00 | 2.00 | 0.08 | 2.18 | 1 |
| | PLACKET POSITION NO.<br>POCKET NO. | | LOGO NO. | | | |

FIG. 15B

CONTINUED ON FIG. 15C

| | | 30W | 22W |
|---|---|---|---|
| TEST PROCESS: | W – | 3.5156 | 3.40 |
| WIDTH: | L – | 8.8724 | 8.20 |
| LENGTH: | | 30L | 22L |

| FRONT CALC | BEFORE | DIFF | OXO SPEC | % |
|---|---|---|---|---|
| FRONT NECK (W) | 15.42 | 0.42 | 15 | 80 |
| F NECK (L) | 0.00 | 0.00 | 0 | 80 |
| SHOULDER (W) | 0.00 | 0.00 | 0 | 80 |
| F ARMHOLE (L) | 10.71 | 0.71 | 10 | 80 |
| ARM–STR. (L) | 10.71 | 0.71 | 10 | 100 |
| F CHEST (W) | 0.00 | 0.00 | 0 | 100 |
| SIDE SEAM (L) | 0.00 | 0.00 | 0 | 100 |
| FRONT (L) | 0.00 | 0.00 | 0 | |

| BACK CALC | ACTUAL | DIFF | OXO SPEC | % 80 | |
|---|---|---|---|---|---|
| BACK NECK (W) | 15.42 | 0.42 | 15.00 | 80 | |
| BACK NECK (L) | 0.00 | 0.00 | 0.00 | 80 | 67–88–58" |
| SHOULDER (W) | 0.00 | 0.00 | 0.00 | 80 | 00–31–3/4" |
| B ARMHOLE (L) | 0.00 | 0.00 | 0 | 100 | 82–93–7/8" |
| B CHEST (W) | 0.00 | 0.00 | 0 | 100 | 94–1.0–1" |
| SLV HEAD (L) | 0.00 | 0.00 | 0 | 100 | |
| SLEEVE (W) | 0.00 | 0.00 | 0 | 100 | |
| NET SLV (L) | 0.00 | 0.00 | 0 | 100 | |

| | | | | |
|---|---|---|---|---|
| YOKE (W) | 10.26 | 0.28 | 9.98 | 80 |
| YOKE (L) | 4.57 | 0.30 | 4.27 | 80 |
| TOP BACK (W) | 8.72 | 0.24 | 8.48 | 80 |

FIG. 15C

MASTER KNIT FORMULA #1 W–100% L–100% USING 80%+20%
BREAKDOWN OR 100% SHRINKAGE

34I

TABLE 1 FOR KNIT SHIRT W/SELF COLLAR & CUFF

CONTINUED ON

AND FIG. 16C

| 39 | | 32 | 32 SPEC | 12 | 42 DIFF | 40 | 44 ACTUAL SHRINK RATE | 14 | |
|---|---|---|---|---|---|---|---|---|---|
| | | | | | | | | 0.00 | |
| | | | | | | | | 0 | |
| | | | | | | | | 0.00 | |
| | | | | | | | | 0.00 | |
| | | | | | | | | % | |
| W | 1. CHEST | 23.00 | 23.00 | | 0.81 | | 23.81 | 1.00 | 36 |
| W | 2. WAIST | 23.00 | 23.00 | | 0.81 | | 23.81 | 1.00 | |
| W | 3. BOTTOM | 23.00 | 23.00 | | 0.81 | | 23.81 | 1.00 | |
| L | 4. FRONT LENGTH | 28.50 | 28.50 | | 2.53 | | 31.03 | 1.00 | |
| L | 5. BACK LENGTH | 30.00 | 30.00 | | 2.66 | | 32.66 | 1.00 | |
| W | 6. SHOULDER TO SHOULDER | 19.50 | 19.50 | | 0.55 | | 20.05 | 0.08 | |
| LW | 7. ARMHOLE CIRCUM. | 21.00 | 21.00 | | 1.27 | | 22.27 | 0.8 | |
| W | 8. SHOULDER SEAM | 7.00 | 7.00 | | 0.20 | | 7.20 | 0.8 | |
| L | 9. SLV LEN FM ARMHOLE | 23.00 | 23.00 | | 2.04 | | 25.04 | 1.00 | |
| L | 10. SLEEVE LEN FM CB | 32.75 | 32.75 | | 2.31 | | 35.06 | 1.00 | |
| W | 11. MUCLE 2" FM UNDERARM | 9.25 | 0.00 | | 0.33 | | 9.58 | 1.00 | |
| W | 12. SHORT SLV OPENING | | 9.25 | | | | 0.00 | 1.00 | |
| L | 13. SELF CLLR LENGTH | 3.25 | 3.25 | | 0.20 | | 3.45 | 0.7 | |
| W | 14. SELF CLLR WIDTH | 2.00 | 2.00 | | 0.05 | | 2.05 | 0.7 | |
| L | 15. SELF CUFF LENGTH | 16.75 | 16.75 | | 1.04 | | 17.79 | 0.7 | |
| W | 16. SELF CUFF WIDTH | 3.00 | 3.00 | | 0.07 | | 3.07 | 0.7 | |
| W | 17. ACROSS BACK NECK | 3.25 | 3.25 | | 0.08 | | 3.33 | 0.7 | |
| L | 18. | 16.75 | 16.75 | | 0.00 | | 17.94 | 0.8 | |
| W | 19. NECK WIDTH (S TO S) | 6.25 | 6.25 | | 0.18 | | 6.43 | 0.8 | |
| L | 20. NECK DROP | 3.75 | 3.75 | | 0.27 | | 4.02 | 0.8 | |
| L | 21. NECK SEAM CIRCUM. | 16.75 | 16.75 | | 1.19 | | 17.94 | 0.8 | |
| L | 22. | 2.00 | 2.00 | | 0.08 | | 2.18 | 1 | |
| | PLACKET POSITION NO. | | | | | | | | |
| | POCKET NO. | | LOGO NO. | | | | | | |

CONTINUED ON FIG. 16C

FIG. 16B

| | | 30W | 22W |
|---|---|---|---|
| TEST PROCESS: | W – | 3.5156 | 3.40 |
| WIDTH: | L – | 8.8724 | 8.20 |
| LENGTH: | | 30L | 22L |

| FRONT CALC | BEFORE | DIFF | OXO SPEC | % |
|---|---|---|---|---|
| FRONT NECK (W) | 15.42 | 0.42 | 15 | 80 |
| F NECK (L) | 0.00 | 0.00 | 0 | 80 |
| SHOULDER (W) | 0.00 | 0.00 | 0 | 80 |
| F ARMHOLE (L) | 10.71 | 0.71 | 10 | 80 |
| ARM-STR. (L) | 10.71 | 0.71 | 10 | 100 |
| F CHEST (W) | 0.00 | 0.00 | 0 | 100 |
| SIDE SEAM (L) | 0.00 | 0.00 | 0 | 100 |
| FRONT (L) | 0.00 | 0.00 | 0 | |

| BACK CALC | ACTUAL | DIFF | OXO SPEC | % 80 |
|---|---|---|---|---|
| BACK NECK (W) | 15.42 | 0.42 | 15.00 | 80 |
| BACK NECK (L) | 0.00 | 0.00 | 0.00 | 80 |
| SHOULDER (W) | 0.00 | 0.00 | 0.00 | 80 |
| B ARMHOLE (L) | 0.00 | 0.00 | 0 | 100 |
| B CHEST (W) | 0.00 | 0.00 | 0 | 100 |
| SLV HEAD (L) | 0.00 | 0.00 | 0 | 100 |
| SLEEVE (W) | 0.00 | 0.00 | 0 | 100 |
| NET SLV (L) | 0.00 | 0.00 | 0 | 100 |

| | | | | |
|---|---|---|---|---|
| YOKE (W) | 10.26 | 0.28 | 9.98 | 80 |
| YOKE (L) | 4.57 | 0.30 | 4.27 | 80 |
| TOP BACK (W) | 8.72 | 0.24 | 8.48 | 80 |

67-88-58"
00-31-3/4"
82-93-7/8"
94-1.0-1"

FIG. 16C

MASTER KNIT FORMULA #6 W-100% L-100% USING 80%+20%
BREAKDOWN OR 100% SHRINKAGE
TABLE 1 FOR KNIT SHIRT W/SELF COLLAR & CUFF 39 32 32 12 40 42 44 14

| | | | SPEC | DIFF | ACTUAL SHRINK RATE | 0.00<br>0<br>0.00<br>0.00<br>% |
|---|---|---|---|---|---|---|
| W | 1. CHEST | 23.00 | 23.00 | 0.81 | 23.81 | 1.00 36 |
| W | 2. WAIST | 23.00 | 23.00 | 0.81 | 23.81 | 1.00 |
| W | 3. BOTTOM | 23.00 | 23.00 | 0.81 | 23.81 | 1.00 |
| L | 4. FRONT LENGTH | 28.50 | 28.50 | 2.53 | 31.03 | 1.00 |
| L | 5. BACK LENGTH | 30.00 | 30.00 | 2.66 | 32.66 | 1.00 |
| W | 6. SHOULDER TO SHOULDER | 19.50 | 19.50 | 0.55 | 20.05 | 0.08 |
| LW | 7. ARMHOLE CIRCUM. | 21.00 | 21.00 | 1.27 | 22.27 | 0.8 |
| W | 8. SHOULDER SEAM | 7.00 | 7.00 | 0.20 | 7.20 | 0.8 |
| L | 9. SLV LEN FM ARMHOLE | 23.00 | 23.00 | 2.04 | 25.04 | 1.00 |
| L | 10. SLEEVE LEN FM CB | 32.75 | 32.75 | 2.31 | 35.06 | 1.00 |
| W | 11. MUCLE 2" FM UNDERARM | 9.25 | 0.00 | 0.33 | 9.58 | 1.00 |
| W | 12. SHORT SLV OPENING | | 9.25 | | 0.00 | 1.00 |
| L | 13. SELF CLLR LENGTH | 3.25 | 3.25 | 0.20 | 3.45 | 0.7 |
| W | 14. SELF CLLR WIDTH | 2.00 | 2.00 | 0.05 | 2.05 | 0.7 |
| L | 15. SELF CUFF LENGTH | 16.75 | 16.75 | 1.04 | 17.79 | 0.7 |
| W | 16. SELF CUFF WIDTH | 3.00 | 3.00 | 0.07 | 3.07 | 0.7 |
| W | 17. ACROSS BACK NECK | 3.25 | 3.25 | 0.08 | 3.33 | 0.7 |
| L | 18. | 16.75 | 16.75 | 0.00 | 17.94 | 0.8 |
| W | 19. NECK WIDTH (S TO S) | 6.25 | 6.25 | 0.18 | 6.43 | 0.8 |
| L | 20. NECK DROP | 3.75 | 3.75 | 0.27 | 4.02 | 0.8 |
| L | 21. NECK SEAM CIRCUM. | 16.75 | 16.75 | 1.19 | 17.94 | 0.8 |
| L | 22. | 2.00 | 2.00 | 0.08 | 2.18 | 1 |
| | PLACKET POSITION NO.<br>POCKET NO. | | LOGO NO. | | | |

FIG. 17B

CONTINUED ON FIG. 17C

| | | 30W | 22W |
|---|---|---|---|
| TEST PROCESS: | W – | 3.5156 | 3.40 |
| WIDTH: | L – | 8.8724 | 8.20 |
| LENGTH: | | 30L | 22L |

| FRONT CALC | BEFORE | DIFF | OXO SPEC | % |
|---|---|---|---|---|
| FRONT NECK (W) | 15.42 | 0.42 | 15 | 80 |
| F NECK (L) | 0.00 | 0.00 | 0 | 80 |
| SHOULDER (W) | 0.00 | 0.00 | 0 | 80 |
| F ARMHOLE (L) | 10.71 | 0.71 | 10 | 80 |
| ARM–STR. (L) | 10.71 | 0.71 | 10 | 100 |
| F CHEST (W) | 0.00 | 0.00 | 0 | 100 |
| SIDE SEAM (L) | 0.00 | 0.00 | 0 | 100 |
| FRONT (L) | 0.00 | 0.00 | 0 | |

| BACK CALC | ACTUAL | DIFF | OXO SPEC | % 80 | |
|---|---|---|---|---|---|
| BACK NECK (W) | 15.42 | 0.42 | 15.00 | 80 | 67–88–58" |
| BACK NECK (L) | 0.00 | 0.00 | 0.00 | 80 | 00–31–3/4" |
| SHOULDER (W) | 0.00 | 0.00 | 0.00 | 80 | 82–93–7/8" |
| B ARMHOLE (L) | 0.00 | 0.00 | 0 | 100 | 94–1.0–1" |
| B CHEST (W) | 0.00 | 0.00 | 0 | 100 | |
| SLV HEAD (L) | 0.00 | 0.00 | 0 | 100 | |
| SLEEVE (W) | 0.00 | 0.00 | 0 | 100 | |
| NET SLV (L) | 0.00 | 0.00 | 0 | 100 | |

| | | | | |
|---|---|---|---|---|
| YOKE (W) | 10.26 | 0.28 | 9.98 | 80 |
| YOKE (L) | 4.57 | 0.30 | 4.27 | 80 |
| TOP BACK (W) | 8.72 | 0.24 | 8.48 | 80 |

FIG. 17C 39 32 32 12 42 40 44 14

| | | | SPEC | DIFF | ACTUAL SHRINK RATE | % TO SHRINK |
|---|---|---|---|---|---|---|
| | | | | | | 0.00% |
| | | | | | | 0.00% |
| | | | | | | 0.00 |
| | | | | | | 0.00 |
| L | WAIST BAND | 32.50 | 32.50 | 2.35 | 34.85 | 0.8 |
| W | WAIST (PATT MEAS) | 33.00 | 33.00 | 1.06 | 43.06 | 1.00 |
| W | HI HIP | 38.00 | 38.00 | 1.22 | 39.22 | 1.00 |
| W | LOW HIP | 45.00 | 45.00 | 1.45 | 46.45 | 1.00 |
| W | THIGH | 11.75 | 11.75 | 1.06 | 12.81 | 1.00 |
| W | KNEE | 16.00 | 16.00 | 1.12 | 17.12 | 1.00 |
| W | LEG OPENING | 28.50 | 28.50 | 2.57 | 31.07 | 1 |
| L | TRUE RISE | 10.50 | 10.50 | 0.71 | 11.21 | 0.75 |
| L | RAISE FRT & BK APEX | 10.50 | 10.50 | 0.19 | 10.69 | 0.2 |
| L&W | FRONT RISE | 11.00 | 11.00 | 0.47 | 11.47 | 0.95 |
| L&W | BACK RISE | 15.00 | 15.00 | 0.82 | 15.82 | 0.95 |
| L | INSEAM | 32.00 | 32.00 | 2.74 | 34.74 | 0.95 |
| L | SIDE SEAM | 42.00 | 42.00 | 3.95 | 45.95 | 0.75 |

POCKET NO.
POCKET POSITION NO.
LOGO NO. LOGO POSITION NO.

FIG. 18B

CONTINUED ON FIG. 18C

TEST PROCESS:

| | | 30W | 22W |
|---|---|---|---|
| WIDTH: | W – | 3.21734 | 3.12 |
| LENGTH: | L – | 9.02389 | 8.33 |
| | | 30L | 22L |

| | FRONT CALC | NEW M | DIFF | |
|---|---|---|---|---|
| L | WAIST BAND | 0.00 | 0.00 | 0 |
| W | WAIST (FRT) | 0.00 | 0.00 | 0 |
| W | HI HIP (FRT) | 0.00 | 0.00 | 0 |
| W | LO HIP (FRT) | 0.00 | 0.00 | 0 |
| L | TRUE RISE | 0.00 | 0.00 | 0 |
| L | INSEAM | 0.00 | 0.00 | 0 |
| L | SIDE SEAM (L) | 0.00 | 0.00 | 0 |

| | BACK CALC | NEW M | DIFF | | |
|---|---|---|---|---|---|
| L | FRT & BK APEX | 11.16 | | 10.5 | 57–90–84" |
| L&W | FRT RISE | 0.00 | | 0 | 00–01–34" |
| L&W | BACK RISE | 15.29 | | 15 | 22–39–79" |
| | | | | | 11–10–1" |

FIG. 18C 39 32 32 12 42 40 44 14

| | | | SPEC | DIFF | ACTUAL SHRINK RATE | % TO SHRINK |
|---|---|---|---|---|---|---|
| | | | | | | 0.00% |
| | | | | | | 0.00% |
| | | | | | | 0.00 |
| | | | | | | 0.00 |
| L | WAIST BAND | 32.50 | 32.50 | 2.35 | 34.85 | 0.8 |
| W | WAIST (PATT MEAS) | 33.00 | 33.00 | 1.01 | 43.06 | 1.00 |
| W | HI HIP | 38.00 | 38.00 | 1.16 | 39.16 | 1.00 |
| W | LOW HIP | 45.00 | 45.00 | 1.38 | 46.38 | 1.00 |
| W | THIGH | 11.75 | 11.75 | 1.01 | 12.76 | 1.00 |
| W | KNEE | 16.00 | 16.00 | 1.06 | 17.06 | 1.00 |
| W | LEG OPENING | 28.50 | 28.50 | 2.44 | 30.94 | 1 |
| L | TRUE RISE | 10.50 | 10.50 | 0.71 | 11.21 | 0.75 |
| L | RAISE FRT & BK APEX | 10.50 | 10.50 | 0.19 | 10.69 | 0.2 |
| L&W | FRONT RISE | 11.00 | 11.00 | 0.47 | 11.47 | 0.95 |
| L&W | BACK RISE | 15.00 | 15.00 | 0.82 | 15.82 | 0.95 |
| L | INSEAM | 32.00 | 32.00 | 2.74 | 34.74 | 0.95 |
| L | SIDE SEAM | 42.00 | 42.00 | 3.95 | 45.95 | 0.75 |
| | POCKET NO. | | | | | |
| | POCKET POSITION NO. | | | | | |
| | LOGO NO. | | LOGO POSITION NO. | | | |

FIG. 19B

CONTINUED ON FIG. 19C

TEST PROCESS:

| | | 30W | 22W |
|---|---|---|---|
| WIDTH: | W – | 3.21734 | 3.12 |
| LENGTH: | L – | 9.02389 | 8.33 |
| | | 30L | 22L |

| | FRONT CALC | NEW M | DIFF | |
|---|---|---|---|---|
| L | WAIST BAND | 0.00 | 0.00 | 0 |
| W | WAIST (FRT) | 0.00 | 0.00 | 0 |
| W | HI HIP (FRT) | 0.00 | 0.00 | 0 |
| W | LO HIP (FRT) | 0.00 | 0.00 | 0 |
| L | TRUE RISE | 0.00 | 0.00 | 0 |
| L | INSEAM | 0.00 | 0.00 | 0 |
| L | SIDE SEAM (L) | 0.00 | 0.00 | 0 |

| | BACK CALC | NEW M | DIFF | |
|---|---|---|---|---|
| L | FRT & BK APEX | 11.16 | | 10.5 |
| L&W | FRT RISE | 0.00 | | 0 |
| L&W | BACK RISE | 15.29 | | 15 |

57–90–84"
00–01–34"
22–39–79"
11–10–1"

FIG. 19C

200

WOVEN SHIRT SHRINKAGE FORMULA SELECTION DATABASE

| SHIRT WOVEN | SHRINKAGE BREAKSOWN | COLLAR SHRINKAGE PERCENT | DURATION (MINUTES) | WASH TEMP (CENT) | FABRIC CONSTRUCTION | FABRIC WEIGHT |
|---|---|---|---|---|---|---|
| A-1<br>A-2<br>A-3 | 60-40<br>60-40<br>60-40 | 60<br>70<br>75 | 20-40 | 30-40 | HIGH COUNT 100/2 OR ABOVE | LIGHT |
| | | | 2.5 | 2 | 1.5 | 1.5 |
| B-1<br>B-2<br>B-3 | 65-35<br>65-35<br>65-35 | 65<br>70<br>75 | 40-70 | 40-50 | MED COUNT 80s TO 100/2 | MED |
| | | | 5 | 4 | 3 | 3 |
| C-1<br>C-2<br>C-3 | 70-30<br>70-30<br>70-30 | 65<br>75<br>80 | 70-100 | 50-60 | LOW COUNT 55s TO 75s | MED TO HEAVY |
| | | | 7.5 | 6 | 4.5 | 4.5 |
| D-1<br>D-2<br>D-3 | 75-25<br>75-25<br>75-25 | 75<br>80<br>85 | 100-58 | 60-70 | 30s TO 55s | HEAVY |
| | | | 10 | 8 | 6 | 6 |
| E-1<br>E-2<br>E-3 | 80-20<br>80-20<br>80-20 | 75<br>80<br>85 | 150-300 | 70-80 | | |
| | | | 12.5 | 10 | 7.5 | 6 |

FIG. 20A

CONTINUED ON FIG. 20B

200

| FABRIC FINISH (HAND FEEL) | TYPE OF WASH | CATEGORY | LINING LAY |
|---|---|---|---|
| FIRM TO MED FIRM | LIGHT GMT WASH/GMT WASH /HVY GMT WASH /SILICON WASH | A SCORE 0 TO 10 | STRAIGHT<br>9 D BIAS<br>45 D BIAS |
| 1.25 | 1 | | |
| MED TO MED SOFT | SAND WASH/ENZYME WASH/ BIO WASH/CHEMICAL WASH/ CHEMICAL WASH/GREEN BALL WASH | B SCORE 10 TO 20 | STRAIGHT<br>9 D BIAS<br>45 D BIAS |
| 2.5 | 2 | | |
| MED SOFT TO SOFT | HVY ENZYME WASH /HVY STONE WASH HVY ENZYME STONE WASH/HVY SAND WASH/ HVY CHEMICAL STONE/CHEMICAL STONE WASH | C SCORE 20 TO 30 | STRAIGHT<br>9 D BIAS<br>45 D BIAS |
| 3.75 | 3 | | |
| EXTRA SOFT | DESTROY WASH/RALPH TEE WASH | D SCORE 30 TO 37 | STRAIGHT<br>9 D BIAS<br>45 D BIAS |
| 4 | 4 | | |
| | TEA STAIN/OVER DYE/ CLOUDY DYE/CROSS DYE/GMT DYE | E SCORE 37 TO 43 | STRAIGHT<br>9 D BIAS<br>45 D BIAS |
| 5.25 | 5 | | |

CONTINUED FROM FIG. 20A

FIG. 20B

210

| WOVEN PANT | SHRINKAGE BREAKDOWN LEN WDTH WA APEX | WASH DURATION (MINUTES) | WASH TEMP (CENT) | FABRIC CONSTRUCTION COUNT | FABRIC WEIGHT | FABRIC FINISH (HAND FEEL) |
|---|---|---|---|---|---|---|
| A-1 | 75 100 75 25 | 20 TO 40 | 30 TO 45 | 90 AND ABOVE | LIGHT | FIRM TO MED FIRM |
| A-2 | " " " " | | | | | |
| A-3 | " " " " | | | | | |
| A-4 | " " " " | | | | | |
| | | 2.5 | 2 | 1.5 | 1.5 | 1.25 |
| B-1 | 80 100 80 20 | 40 TO 70 | 45 TO 60 | 75 TO 90 | MED | MEDIUM |
| B-2 | " " " " | | | | | |
| B-3 | " " " " | | | | | |
| B-4 | " " " " | | | | | |
| | | 5 | 4 | 3 | 3 | 2.5 |
| C-1 | 85 100 85 20 | 70 TO 100 | 60 TO 75 | 55 TO 75 | MED TO HEAVY | MEDIUM SOFT |
| C-2 | " " " " | | | | | |
| C-3 | " " " " | | | | | |
| C-4 | " " " " | | | | | |
| | | 7.5 | 6 | 4.5 | 4.5 | 3.75 |
| D-1 | 90 100 90 15 | 100 TO 150 | 75 TO 90 | 30 TO 55 | HEAVY | EXTRA SOFT |
| D-2 | " " " " | | | | | |
| D-3 | " " " " | | | | | |
| D-4 | " " " " | | | | | |
| | | 10 | 8 | 6 | 6 | 4 |

FIG. 21A

CONTINUED ON FIG. 21B

| TYPE OF WASH | CATEGORY | 6.6 LE TEST (MIN) |
|---|---|---|
| LIGHT GMT WASSH/GMT WASH /HEAVY GMT WASH /SILICON WASH | A 0 TO 10 | 2 TO 5<br>6 TO 9<br>10 TO 13<br>14 TO 18 |
| 1 | | |
| SAND WASH/ENZYME WASH/ BIO WASH/CHEMICAL WASH CHEMICAL WASH/GREEN BALL WASH | B 10 TO 20 | 2 TO 5<br>6 TO 9<br>10 TO 13<br>14 TO 18 |
| 2 | | |
| HVY ENZYME WASH/HVY STONE WASH HVY ENZYME WASH/HVY ENZYME SONE WASH/ HVY SAND WASH/HVY CHEMICAL STONE/ CHEMICAL STONE WASH | C 20 TO 30 | 2 TO 5<br>6 TO 9<br>10 TO 13<br>14 TO 18 |
| 3 | | |
| DESTROY WASH/RALPH TEE WASH/ TEA STAIN/OVER DYE | D 30 TO 40 | 2 TO 5<br>6 TO 9<br>10 TO 13<br>14 TO 18 |
| 4 | 4 | |

CONTINUED FROM FIG. 21A

FIG. 21B

220

| PANTS | | 0 POCKETS | 2 POCKETS | 4 POCKETS | WASH TEST |
|---|---|---|---|---|---|
| ABCD | 1 | 1/2" | 3/8" | 1/4" | 2–5 |
| ABCD | 2 | 3/4" | 5/8" | 9/16" | 6–9 |
| ABCD | 3 | 1 1/4" | 1 1/16" | 7/8" | 10–13 |
| ABCD | 4 | 1 3/4" | 1 1/2" | 1 1/4" | 14–17 |

FIG. 22

METHOD AND SYSTEM FOR PREPARING TEXTILE PATTERNS BEFORE SHRINKAGE

RELATED APPLICATIONS

This application is a continuation of U.S. patent application Ser. No. 10/475,318, filed on Oct. 14, 2003 now U.S. Pat. No. 6,947,807 (371 date of Jun. 17, 2004), which in turn is a National Phase Application on PCT Patent Application No. PCT/US02/11952, filed internationally on Apr. 16, 2002 which in turn claims the benefit of priority from U.S. Provisional Patent Application No. 60/284,091 filed on Apr. 16, 2001, the entirety of which are incorporated by reference herein.

FIELD OF INVENTION

The present invention relates to a system and method for adjusting garment pattern measurements. More specifically, the present invention relates to a system and method for adjusting garment pattern measurements providing an adjusted garment measurement to compensate for bulk wash shrinkage after the garments are fabricated.

BACKGROUND OF THE INVENTION

In the textile industry one of the main obstacles to properly cutting patterns into fabric is related to the shrinkage that occurs during the initial washing. Generally, based on type of fabric, thickness, type of cut and other factors, different materials, and different cut patterns shrink in different proportions such as shrinkage resistance. When designing a textile garment pattern one method of manufacture calls for the clothing designer to supply the manufacturer the final garment measurements assuming that shrinkage has already occurred. This requires the end manufacturer of the desired garment to wash and dry the fabric on the roll so that the shrinkage occurs before the pattern is cut. This allows the pre-shrunk fabric to be assembled according to final garment measurements without any post-assembly aberrations.

Another possible method for manufacturing garments is for the designer to supply the manufacturer the dimensions of garment with additional material calculated in such that the manufacturer can cut the fabric pattern, stitch the garment and wash and shrink it to size. In this case the designer will give specifications for a garment design that are larger than wanted so that the manufacturer can assemble the shirt with fabric cut from an unwashed roll. When the garment is cut, stitched and washed the garment then shrinks down to the desired size for the final garment specification.

This stitching of garment fabric together before the initial shrink washing gives an added texture to the garment in the form of a wrinkling effect around the seam areas of the garment, caused by the shrinking material pulling against the seam stitching. This effect is considered desirable to some fashion designers who include this wrinkled style of garments in their garment lines.

However, there are sometimes variations in the washing and shrinking process between different manufactures, caused by different washing procedures, different fabric origins and other factors. Because of these differences it is hard for a clothing designer to fabricate a single garment design in the above mentioned second method, that is to be cut and stitched before any shrinkage, that will work consistently for all of its manufacturers. Because of this the manufacturers generally get the final garment measurements with instructions to cut and stitch the fabric before shrinkage. This creates a problem for the manufacturer because there is currently no way to expand the fabric measurements from the final garment measurements to the pre-shrinkage cut and stitch dimensions other than by trial and error.

This trial and error method is costly and time consuming, and also has inherent problems with consistency. A manufacturer will receive a fabric pattern for a garment that gives the desired sale measurements. Then it is up to the manufacturer to expand those measurements out so that when the garment is stitched together and washed it will hopefully shrink to the designers final garment measurements. If it does not then modifications need to be made and the process is repeated.

This current system gives rise to a need for a method which can, with considerable accuracy estimate the expansion parameters to convert a designer's final garment measurements into to a pre-shrinkage cut and assemble measurement, such that when the manufacture is asked to cut and assemble the garment before shrinking the fabric, most if not all of the trial and error process of measurement conversion can be eliminated. This invention overcomes the shortcomings of the currently used systems and provides a method for calculating the measurement increases necessary to convert final garment measurements to pre-shrinkage cut and stitch measurements.

SUMMARY OF THE INVENTION

In one embodiment of the present invention a method for improving garment generation is provided, having a garment specification modification program for automatically adjusting for fabric shrinkage from a bulk wash process, is provided comprising the steps of, cutting a unit of fabric from a fabric roll and delineating first and second test fabrics on the unit of fabric, washing the first test fabric under a specified bulk washing condition, measuring the percent of shrinkage in the test fabric, entering the shrinkage results into a garment specification modification program to produce an enlarged garment specification, making a test garment from the fabric roll, washing the test garment along with the second test fabric under the specified bulk washing condition, and checking the second test fabric against the first test fabric to check if the specified bulk wash condition was complied with.

In another embodiment of the present invention the first and second test fabrics are delineated as 18 or 24 inch squares on the unit of fabric. This test fabric is cut at a specified distance from the end cut of said fabric roll. Additional second test fabrics are also delineated and cut from the same fabric roll used as the second test fabric.

In another embodiment of the present invention the method also includes the step of adjusting the formulas in the garment specification modification program if the test garment does not meet the garment specifications and the second test fabric displays the same shrinkage as the first test fabric. Alternatively, the bulk wash test conditions are adjusted if the test garment does not meet the garment specifications and the second test fabric displays different shrinkage as the first test fabric.

In another embodiment of the present invention a garment specification modification program for automatically adjusting for fabric shrinkage from a bulk wash process is provided comprising the steps of a user entering into a computer measuring system the formula corresponding to the garment to be created, a user entering a garment specification corresponding to the target measurements for the garment, a user entering shrinkage results obtained from a test fabric, calculating a shrinkage amount by using the shrinkage results and a modification percentage corresponding to the formula of shrinkage resistance, and modifying the garment specification into an enlarged garment specification by adding the shrinkage amount to the garment specification.

The formula is chosen based on the type and style of fabric, corresponding to an expected shrinkage. The styles of fabric used in the garment includes knit or woven fabrics.

In another embodiment of the present invention, the shrinkage results are obtained from a test fabric taken from the same fabric roll as said garment. The shrinkage results are converted into working shrinkage results to compensate for the additional fabric used in the garment when produced according to enlarged garment specification. This conversion of said shrinkage results into the working shrinkage results utilizes the equation $100((1+x)+(x+x/100))-100/100$, where x=either length or width shrinkage results.

In another embodiment of the present invention, the modification percentages are based on said formula chosen by a user, so as to adjust the shrinkage results to compensate for properties of the fabric and stitching of the garment that may reduce the shrinkage, such as bias seams and stretching properties. The garment specification is modified into the enlarged garment specification for a particular piece of the garment that uses only one orientation of shrinkage results, such as length only or width only, calculated utilizing the equation $((X\ \%\times Y\ \%)\times Sg)+Sg=ESg$, where X=working shrinkage result (for the one direction), Y=modification percentage, Sg=garment specification, and ESg=enlarged garment specification.

In another embodiment of the present invention the modification of the garment specification into the enlarged garment specification for a piece of the garment that uses both length and width shrinkage result direction is calculated utilizing the equation $Sg+(Sg(Zw)(Xw\ \%)(Y\ \%))+(Sg(Zl)(Xl\ \%)(Y\ \%))$, where Xw=working shrinkage result for width, Xl=working shrinkage result for length, Y=modification percentage, Zw=combination fraction for width, Zl=combination fraction for length, Sg=garment specification, and ESg=enlarged garment specification.

BREIF DESCRIPTION OF THE FIGURES

Figure 4A:
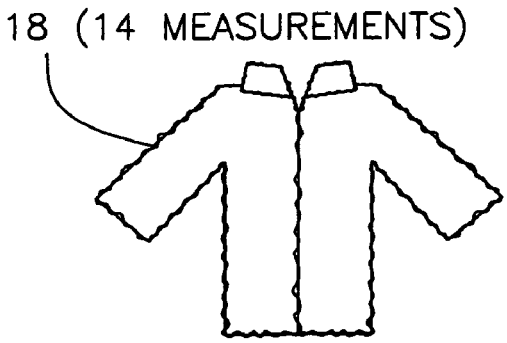
Figure 4B:
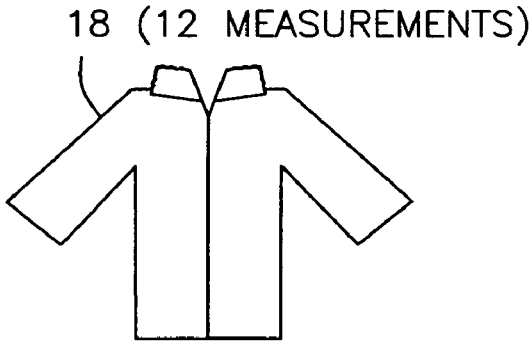
Figure 5:
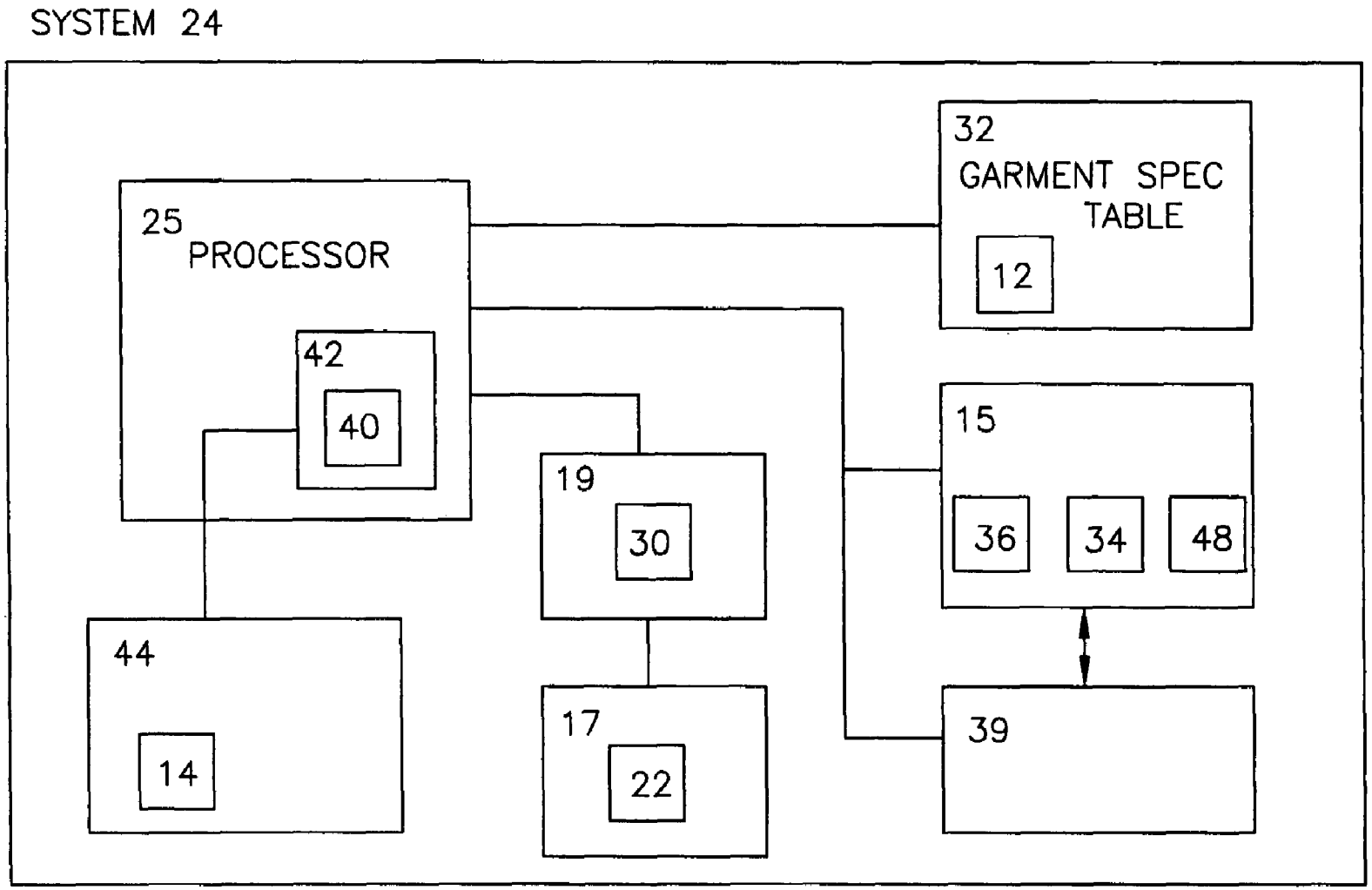
Figure 6:
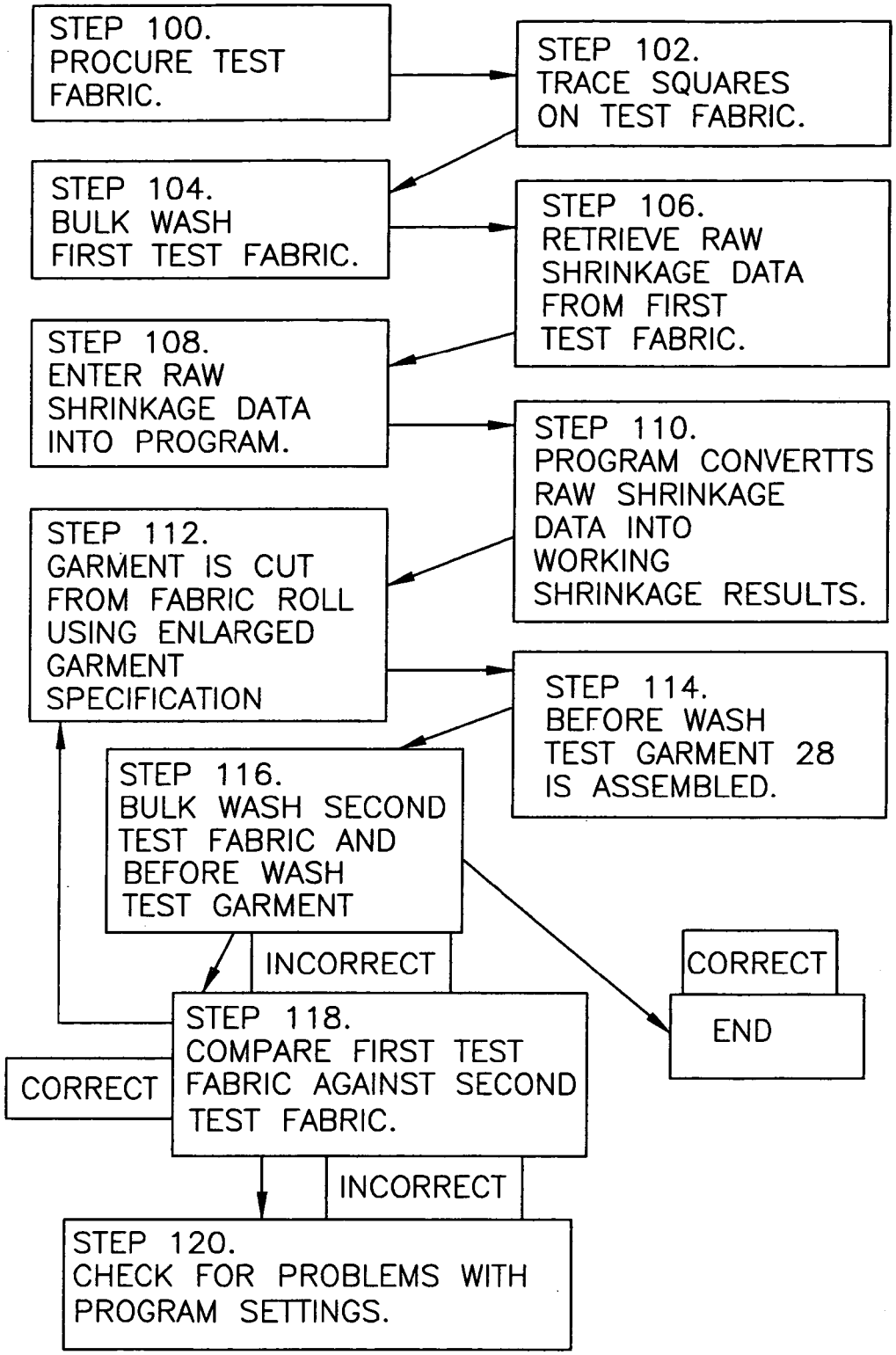
Figure 7:
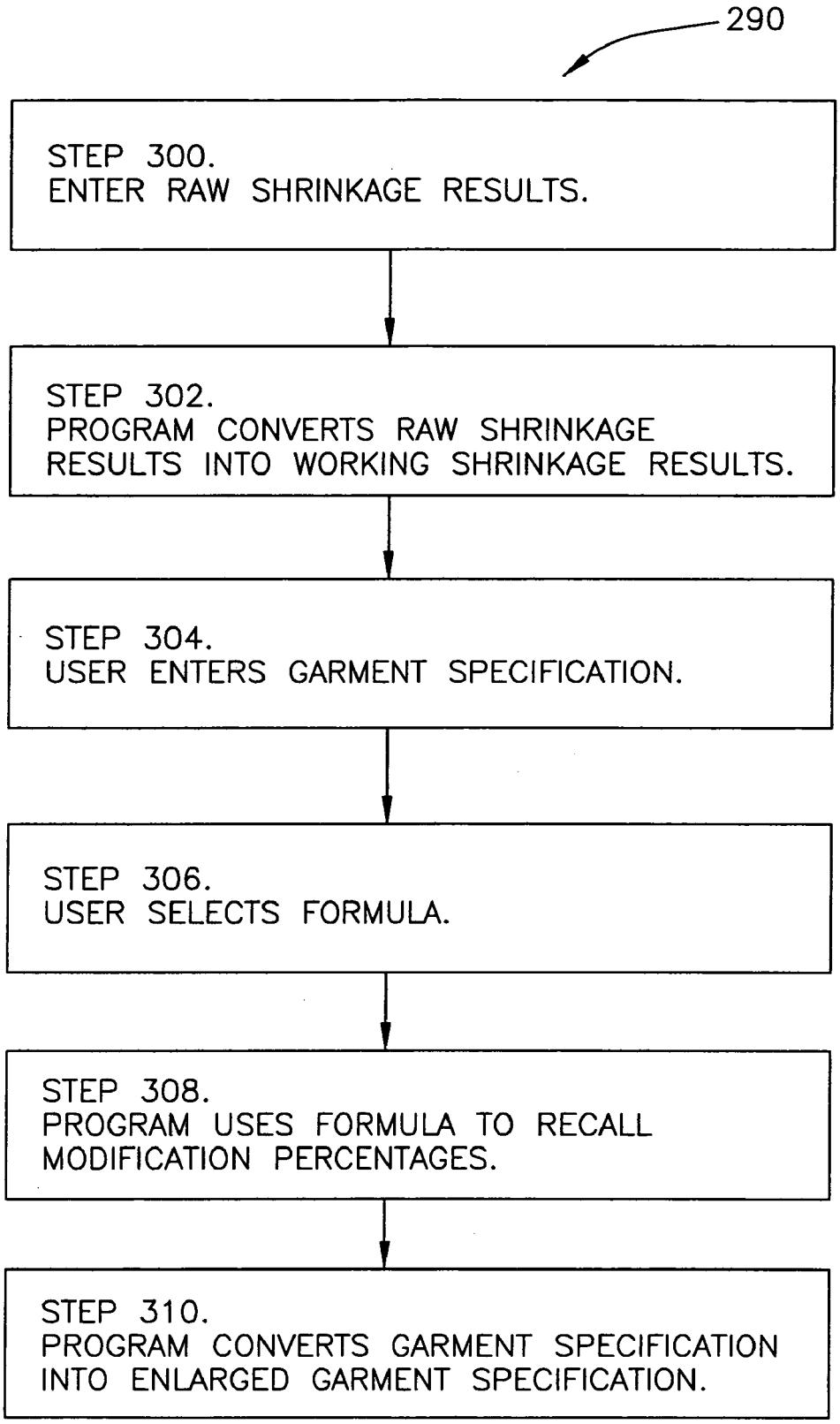

FIG. 4*a* illustrates a garment to enlarged garment specifications, in accordance with one embodiment of the present invention;

FIG. 4*b* illustrates a garment to correct garment specification, in accordance with one embodiment of the present invention;

FIG. 5 illustrates system for preparing textile patterns before shrinkage, in accordance with one embodiment of the present invention;

FIG. 6 is a flow diagram for a method for preparing textile patterns before shrinkage FIG. 7 is flow diagram for operating a system for preparing textile patterns before shrinkage, as illustrated in FIG. 5, in accordance with one embodiment of the present invention;

FIGS. 8–19 illustrates a printout of results obtained using a system for preparing textile patterns before shrinkage, as illustrated in FIG. 5, in accordance with one embodiment of the present invention;

FIGS. 20–21 illustrates a bulk wash formula table, in accordance with one embodiment of the present invention; and FIG. 22 illustrates a shrinkage chart, in accordance with one embodiment of the present invention;

DETAILED DESCRIPTION OF THE PREFERRED EMBODIMENTS

In one embodiment of the present invention, a system and method for modifying garment specifications, comprises many steps, allowing a user to begin with a first garment specification and to modify it into an enlarged garment specification such that when a garment is prepared with enlarged garment specification and subsequently assembled and bulk washed, it will be in accordance with or be within acceptable tolerance of the original first garment specifications.

Figure 1:
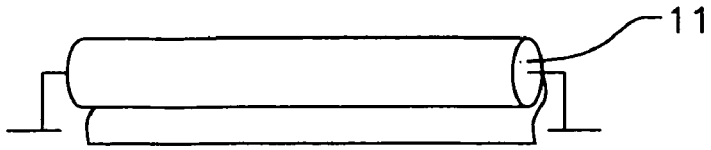
FIG. 1 illustrates a fabric roll, in accordance with one embodiment of the present invention.
Figure 2:
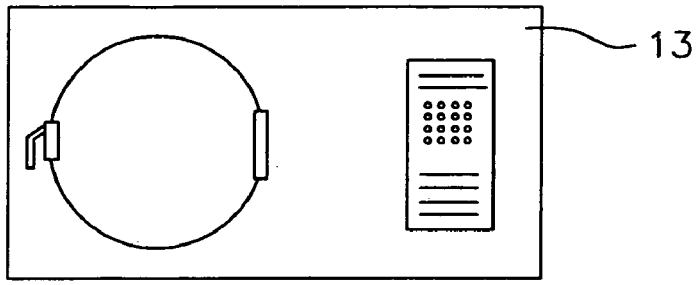
FIG. 2 illustrates a bulk washing device, in accordance with one embodiment of the present invention.

The present invention relates to a method 10 for garment manufacturers to fabricate a garment that is oversized, such that when it is shrunk during the bulk wash process it will conform to a garment specification 12. To this end, as illustrated in FIGS. 1 and 2, the garment manufacturer will uses fabric cut from fabric roll 11 and bulk washing device 13.

Figure 3:
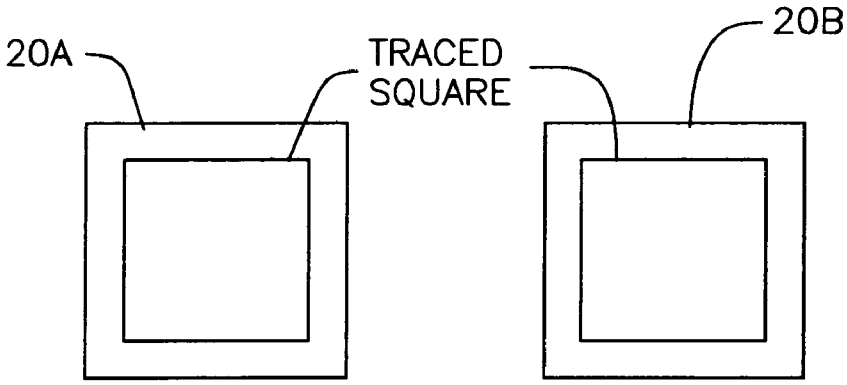
FIG. 3 illustrates test fabrics, in accordance with one embodiment of the present invention.

During the garment fabrication process, a first test fabric 20*a* and a second test fabric 20*b* are cut from the same fabric roll 11 to be used during the creation of garment 18. As illustrated in FIG. 3 test fabrics 20*a* and 20*b* are cut in equal sizes. Preferably, 24 inch squares are traced onto test fabrics 20 such that they generally reflect the average size fabric cut to be used in the garment 18. A more detailed description of test fabrics 20 and their use is described below.

In addition to test fabrics 20, the garment manufacturer must create garment 18. To this end, the manufacture begins with garment specification 12 given to him by the designer. However, in order to proceed with garments 18 that are designed to be assembled before the bulk washing process, garment specifications 12 need to be modified into enlarged garment specifications 14 via pre wash modification system 24.

To illustrate this FIGS. 4*a* and 4*b* display how garment 18 will appear differently throughout the fabrication process. FIG. 4*a* illustrates garment 18 before bulk washing, created using enlarged garment specification 14. The material used will be oversized for the stitching lengths causing a ruffling at the seems. FIG. 4*b* illustrates garment 18 after the bulk wash, conforming to garment specification 12. After bulk washing garment 18, the fabric has shrunk to match the stitching and meets the requirements of th garment specification 12. Additionally, because garment 18 was assembled before it was shrunk, the seams will display a particular texture that can not be achieved by assembling garment 18 after bulk washing the fabric.

To achieve this, system 24 allows the manufacturer to increase the garment specification 12 into enlarged garment specification 14 such that when a garment 18 is fabricated according to enlarged garment specification 14, and then bulk washed under specified conditions, the resulting after wash garment will comply with the original garment specification 12 provided by the designer.

As illustrated in FIG. 5, system 24 is comprised of a pre-wash processor 25, a garment specification table 32 populated by original garment specifications 12, a formula table 15 populated by data relating to the selected formula 34 the corresponding modification percentages 36 and combination fractions 48 (if necessary), shrinkage percentage orientation table 39, a raw shrinkage data table 17 populated by raw shrinkage results 22, a working shrinkage result calculator 19 for producing working shrinkage results 30 from raw shrinkage results 22, a shrinkage amount table 42 populated by the shrinkage amounts 40, and a enlarged garment specification table 44 populated by the calculated enlarged garment specification 14. The complete operation of system 24 is described in more detail below.

Method to Prepare Modified Garment Specification—Test Fabric with Control

In one embodiment of the present invention a garment manufacturer receives garment specification 12 corresponding to an after-bulk wash specification where the pattern is to be cut and assembled into garment 18 and then bulk-washed and shrunk to meet the requirements of garment specification 12. This technique is used to produce desired effects not attainable by bulk washing garment pieces, before assembly.

As depicted in a flow chart 90 as seen in FIG. 6, at a first step 100 the manufacturer begins by procuring test fabric 20 made of the same material to be used by garment 18. Test fabric 20 should be relaxed or removed from the roll so it will be treated similarly to the actual treatment of garments 18 that will be produced from the same or similar rolls. Additionally, to prevent test fabric 20 from presenting aberrant shrinkage behavior, test fabric 20 should be taken from a piece of fabric roll 11 that is at least three yards from the end cut. This will assure that test fabric 20 will be composed of fabric that was produced and treated under similar stresses and tensions as the fabric that will ultimately be used in producing garments 18.

Next, at step 102, two squares of acceptable size, for example 24 inches, are traced onto test fabric 20 and separated into test fabric 20*a* and test fabric 20*b*. Several copies of test fabric 20*b* can be produced from test fabric 20 in case of any problems with the bulk wash settings of before-wash test garment 28 in steps 114–116 as will be discussed later. At step 104 test fabric 20*a* is washed under the specified bulk wash conditions while test fabric 20*b* is stored for use later in the process. Next, at step 106 test fabric 20*a* is measured producing raw shrinkage results 22 for test fabric 20*a*.

Shrinkage results 22 consist of two components a length shrinkage measurement 22*l* and a width shrinkage measurement 22*w*. It is important to note that the orientation of the test fabric with relation to the fabric roll determines which measurement is which. Length shrinkage measurement 22*l* is based on the shrinkage perpendicular to the spindle axis of fabric roll 11. Width shrinkage measurement 22*w* is based on the shrinkage along the spindle axis of fabric roll 11. Even if test fabric 20*a* is of a square shape the shrinkages under bulk wash conditions will be different. A greater shrinkage is expected in length shrinkage measurement 22*l* based on various factors that affect fabric tension as it is placed on fabric roll 11 including but not limited to the tension at which it is was placed on the roll and the stitching pattern.

At step 108, raw shrinkage results 22 are entered in to system 24 which alters the original garment specifications 12 into enlarged garment specification 14 such that when garment 18 is assembled and shrunk it will be in accordance with original garment specification 12. A more detailed description of system 24 is described in the next portion of the specification and will more fully describe the process of converting garment specification 12 into enlarged garment specification 14.

After system 24 enlarges the input garment specification 12 into an output enlarged garment specification 14 the user proceeds to step 110 where system 24 then displays enlarged garment specification table 44 populated by the calculated enlarged garment specifications 14. Enlarged garment specifications 14 are then entered by the user into the device that will be cutting the fabric from fabric roll 11. Both steps 108 and 110 are more fully described below in the section discussing the operation of garment specification modification program 24.

Next, at step 112 one sample before-wash test garment 28 is cut from fabric roll 11 and assembled in accordance with enlarged garment specification 14. The fabric used to create garment 18 and before wash test garment 28 is cut from fabric roll 11 using a digital CAD/CAM device in accordance with the output of system 24. However, the CAD/CAM (Computer Aided Drafting/CAM) device is not necessary, any means of cutting the fabric from fabric roll 11 in accordance with enlarged garment specification 14 is within the contemplation of the present invention.

At step 114, the assembled before-wash test garment 28 is then washed under the same conditions as the bulk washing that all of the garments from fabric roll 11 will be washed At step 116, test fabric 20*b*, used as a control, is washed along with before-wash test garment 28. Before-wash test garment 28 is checked to see if it is within acceptable tolerance of the requirements of garment specification 12. If before-wash test garment 28 is within an acceptable tolerance, then the initial settings used in system 24 were correct and the process for cutting of fabric in accordance with enlarged garment specification 14 can commence for the desired number of garments 18.

However, if before wash test garment 28 has shrunk too much or shrunk too little, or some combination of the two along different axes, then the user must proceed to an adjustment mode. A this point, step 118, test fabric 20*b* is checked against test fabric 20*a*. If test fabrics 20*a* and 20*b* are different, then it is possible that modification to the washing process or bulk washing device 13 are at fault for the aberrations in the outcome of before-wash test garment 28. Some conditions that could cause aberrations in the bulk wash process include but are not limited to humidity factors, heat variations in drying and water/detergent quality. If this is the case, the process should be repeated from step 112 paying careful attention to maintain consistent bulk wash conditions during the repeating of step 114.

However, assuming the shrinkage of the two test fabrics 20*a* and 20*b* are the same, then it can be assumed that the bulk wash conditions remained the same between the first washing of test fabric 20*a*, and the second washing for before-wash test garment 28 and test fabric 20*b*. If this is the case the user returns to steps 108–110 and to system 24 for adjustments that will be discussed in more detail below. This process is repeated until before wash test garment 28 comes within a acceptable tolerance of garment specification 12 at step 116.

Operation of Garment Specification Modification Program

In another embodiment of the present invention, pre-wash modification system 24 is employed to convert garment specification 12 into enlarged garment specification 14. System 24 relates specifically to the process discussed above in steps 108 and 110 of the overall method 10. System 24 utilizes raw shrinkage results 22, listed in raw shrinkage data table 17, from test fabric 20*a* to modify garment specification 12, resulting in enlarged garment specification 14 such that the trial and error process currently employed can be mostly avoided. By using shrinkage results 22 and modifying them based on direction the garment pieces are cut and the type of fabric and type of patterns (shirt, pants, yoke area, ect.), system 24 estimates the exact enlarged garment specification 14, significantly reducing the lengthy process of trial and error.

Figure 8A:
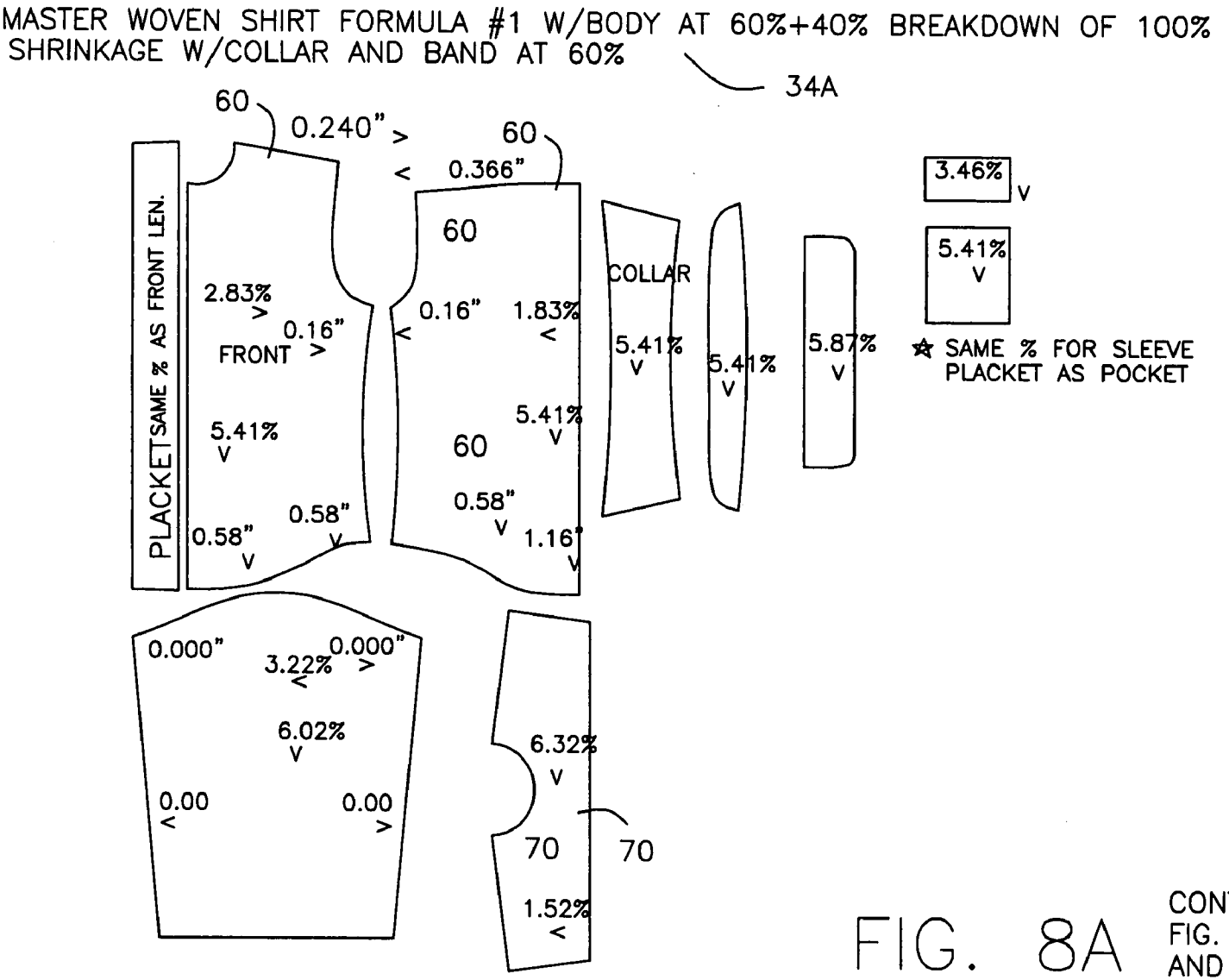
Figure 9A:
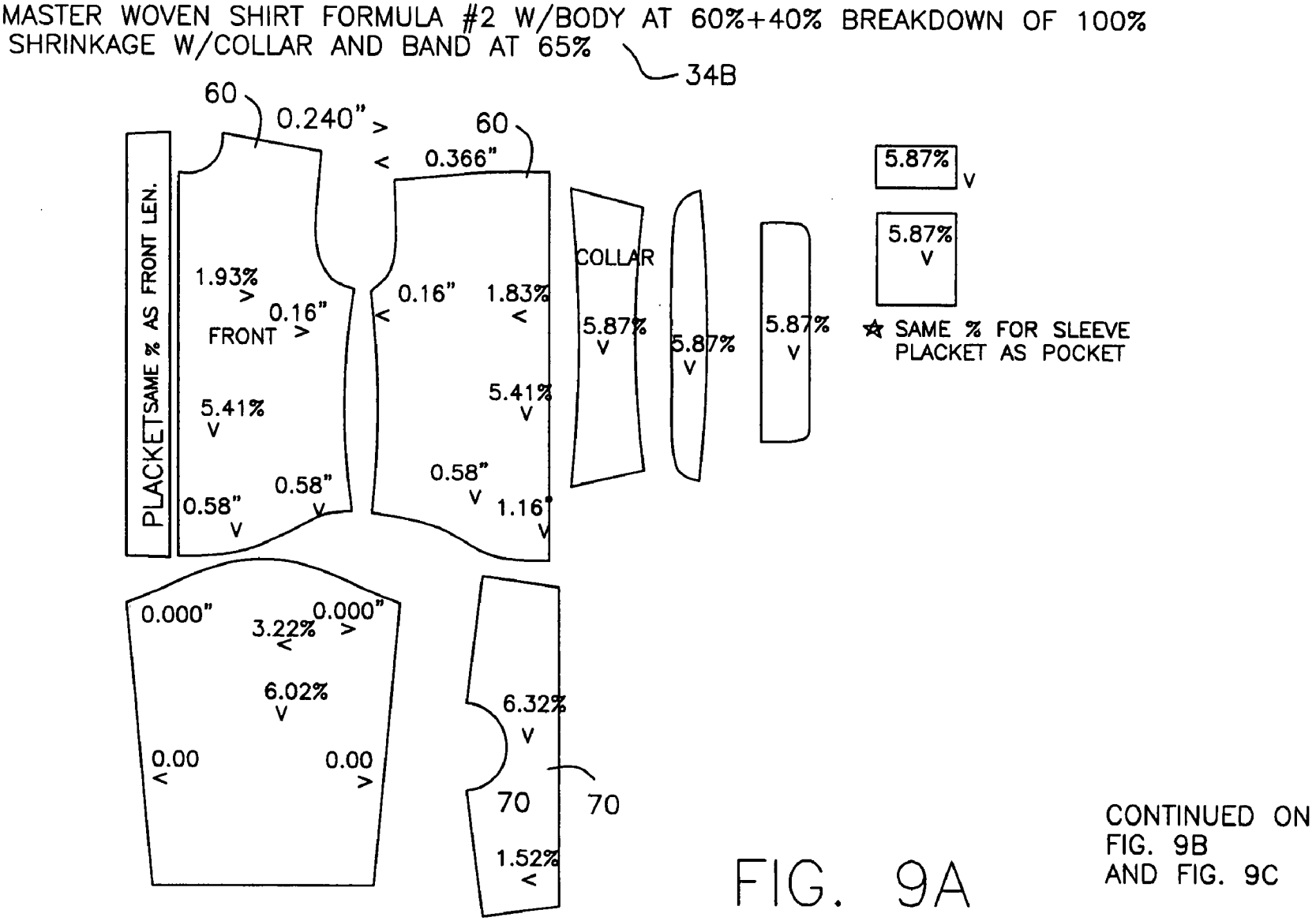
Figure 10A:
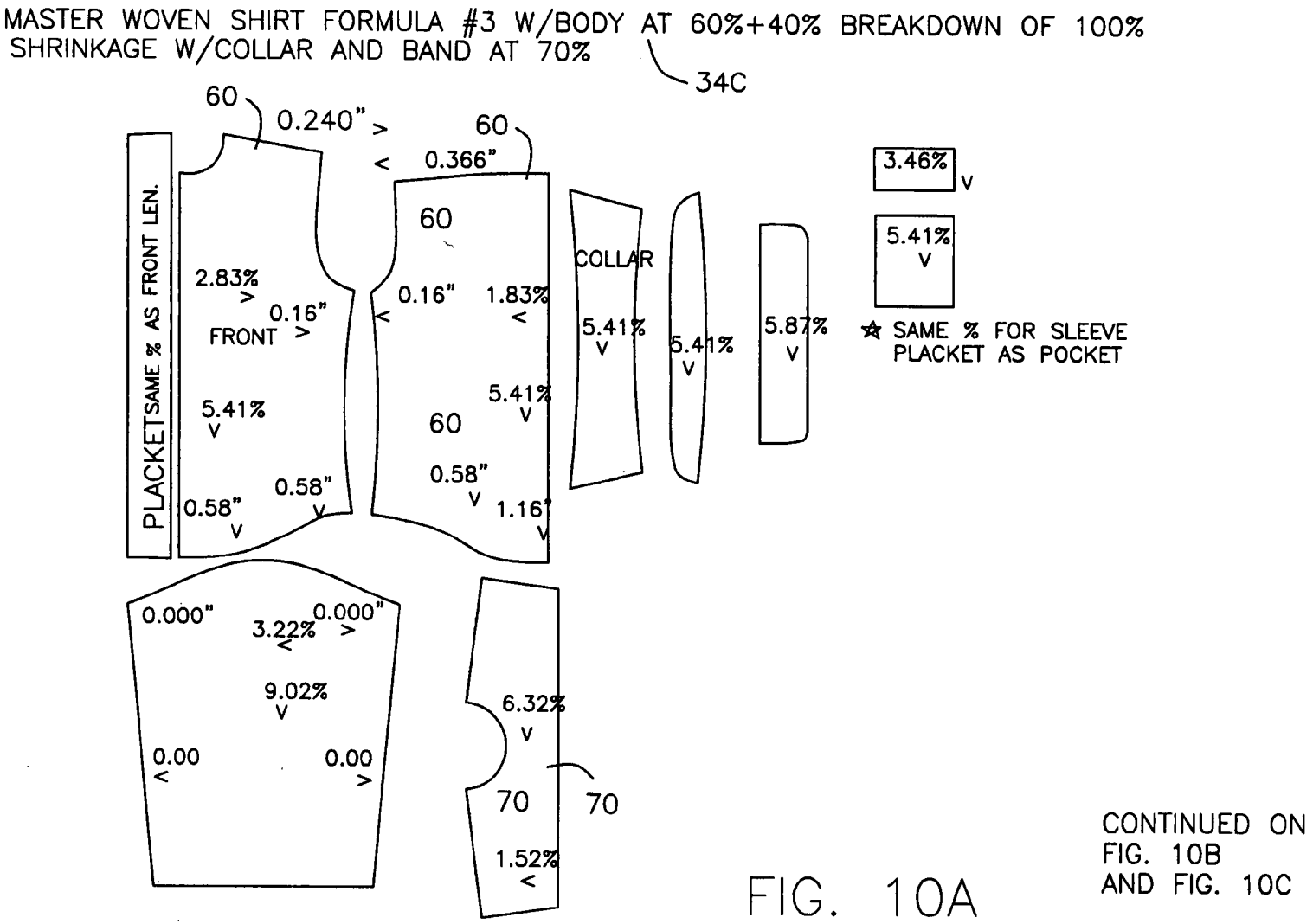
Figure 11A:
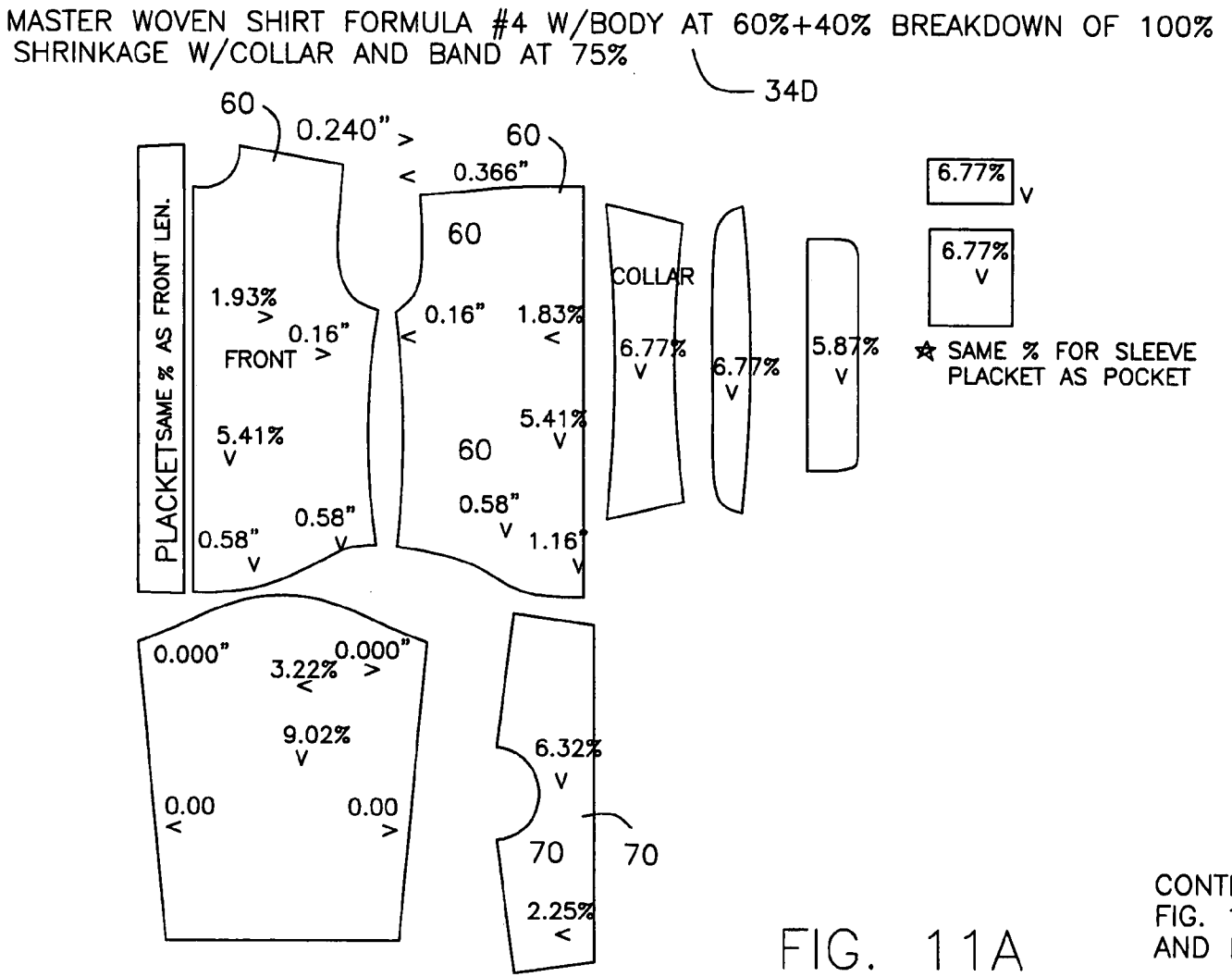
Figure 12A:
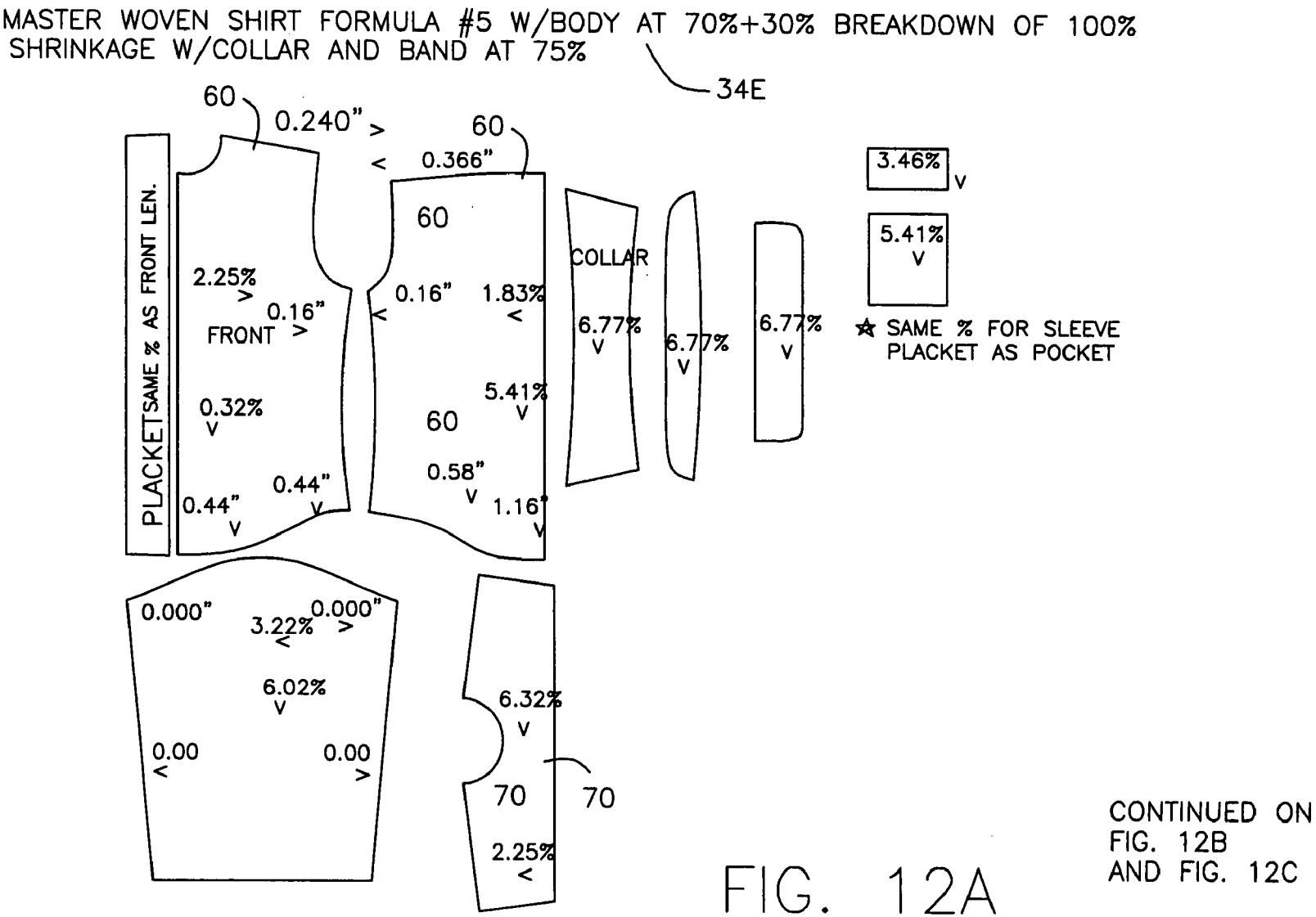
Figure 13A:
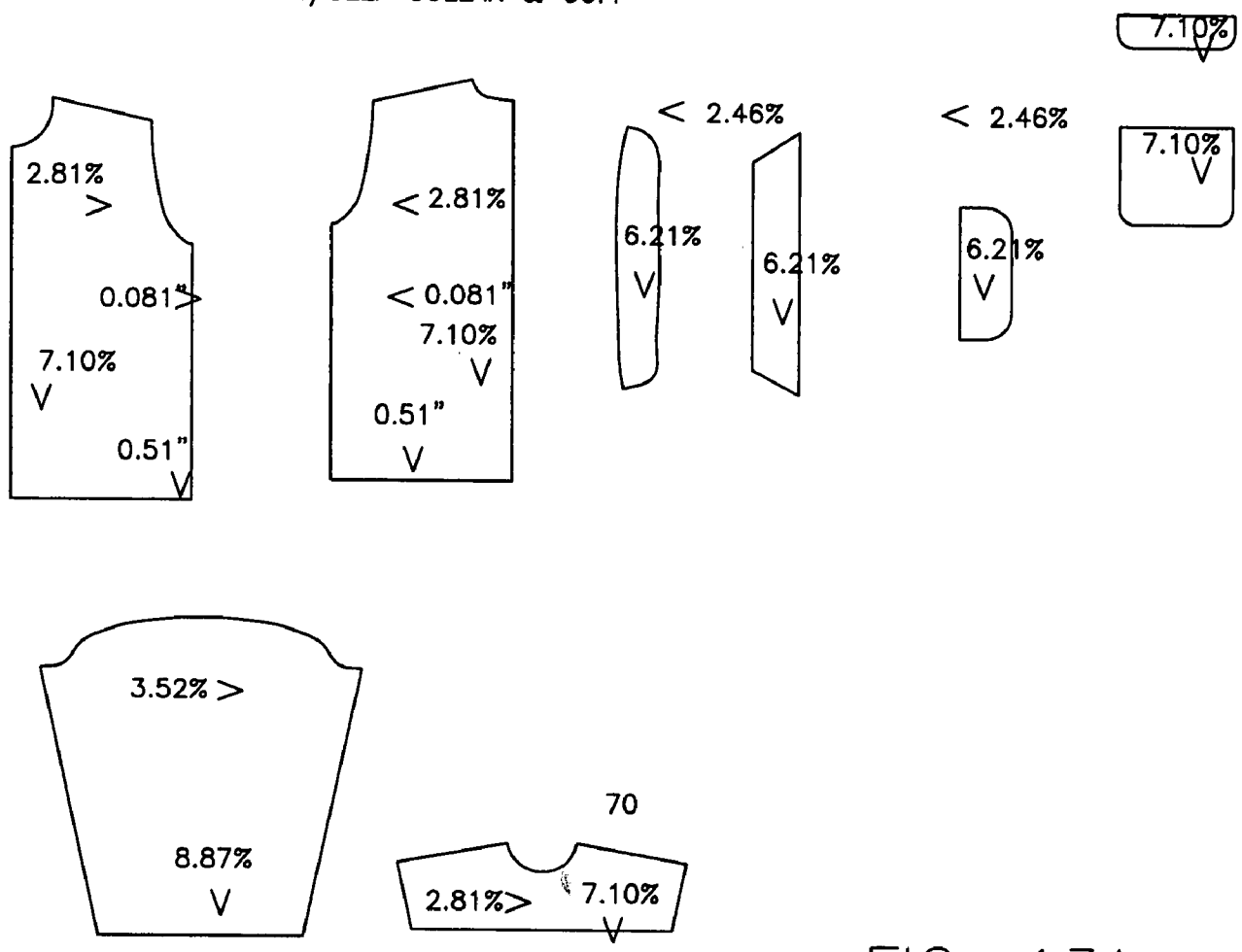
Figure 14A:
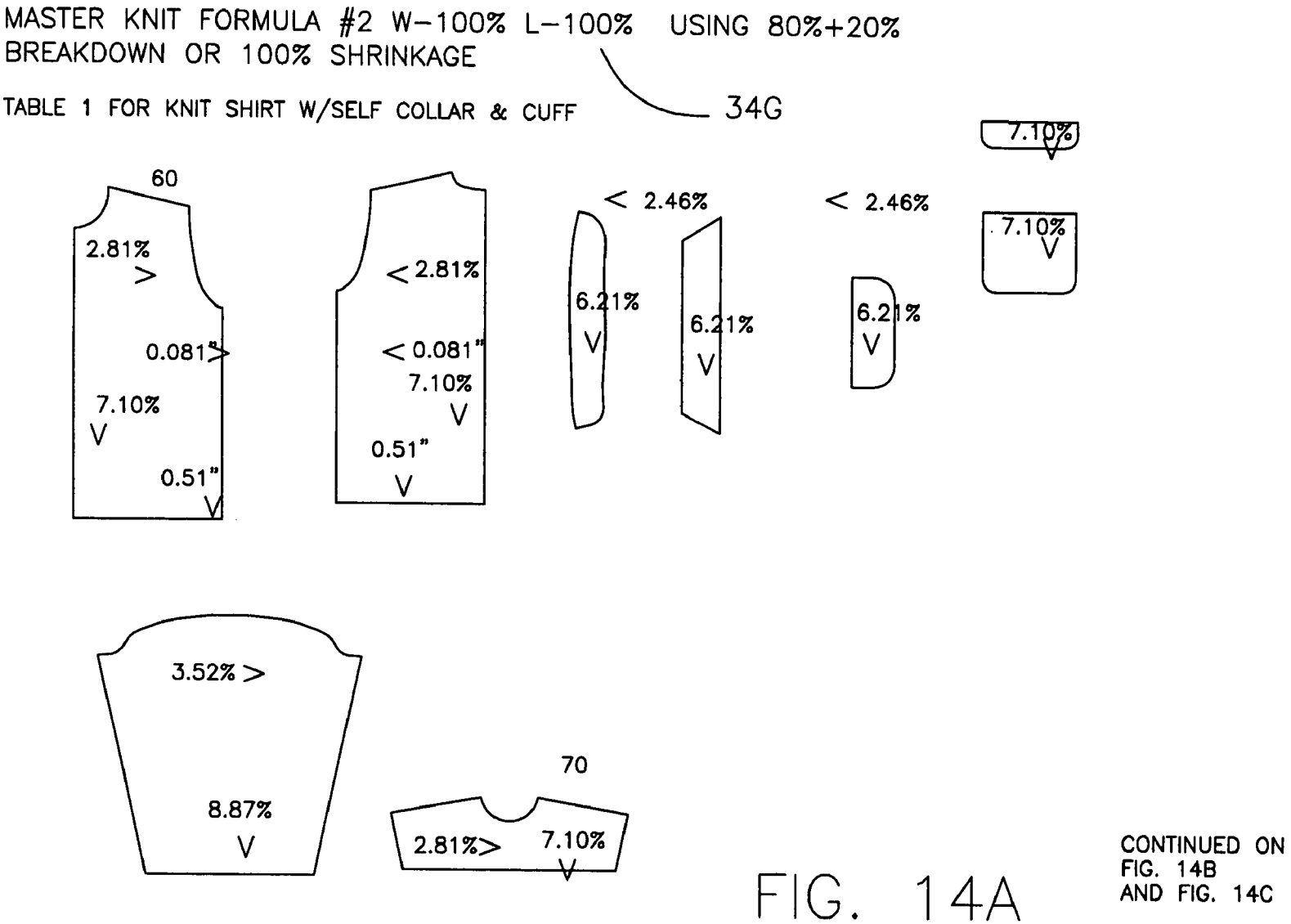
Figure 15A:
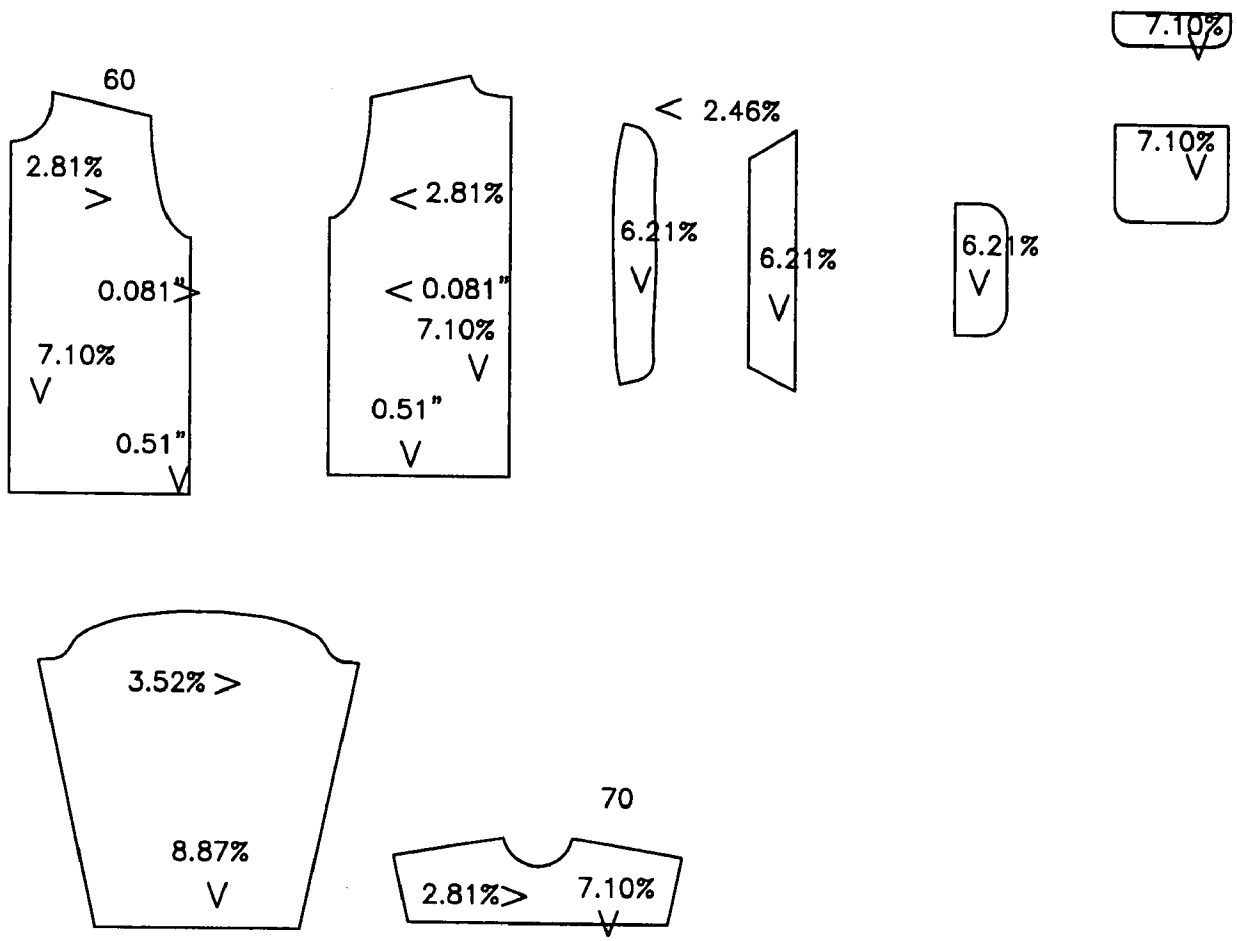
Figures 16A, 16B:
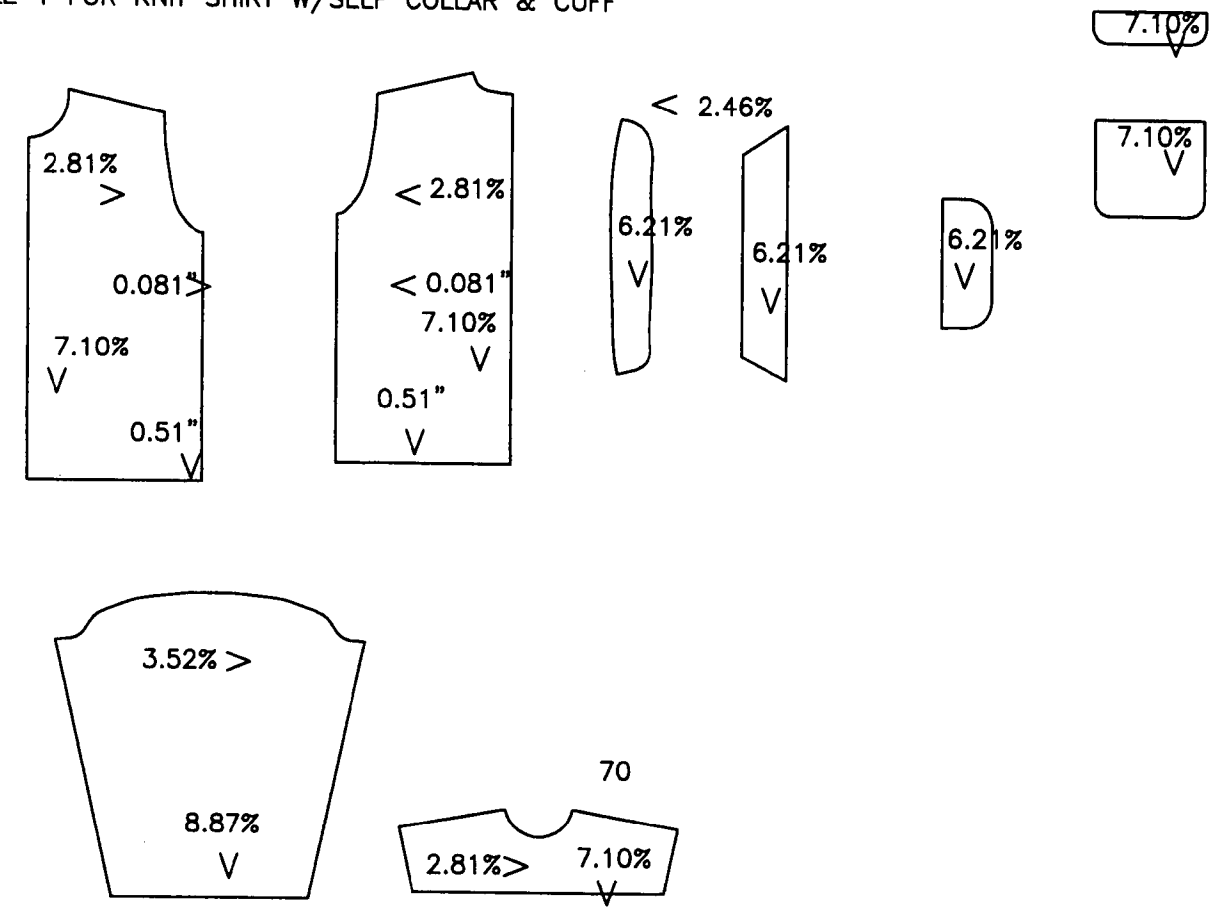
Figure 17A:
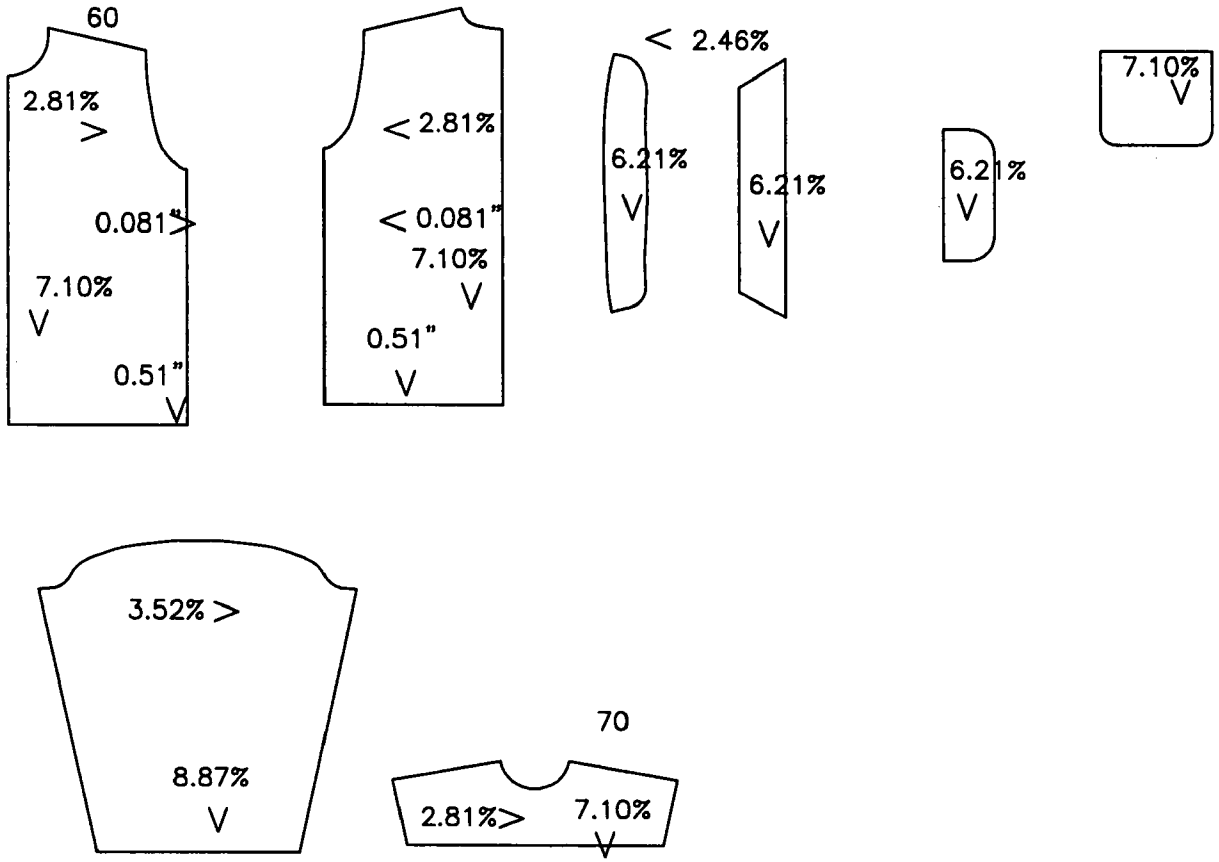

A more detailed description of one example of the present invention is illustrated in FIGS. 7 and 8. FIG. 7 illustrates a flow chart 290 of the operation of the system 24. FIG. 7 illustrates a print-out 25 from system 24 of enlarged garment specification 14 corresponding to formula 34*a*. This print-out 25 illustrates the data contained in raw shrinkage data table 17, working shrinkage results 30, garment specification table 32, shrinkage amount table 42, enlarged garment specification table 43, and shrinkage percentage orientation table 39.

At a first step 300 in the operation of system 24, the user must enter both length shrinkage results 22*l* and width shrinkage results 22*w* into raw shrinkage data table 17. These shrinkage results 22 that are entered into system 24 represent the raw shrinkage percentages of test fabric 20*a*. The size of test fabric 20*a* can be of any size that would accurately display the shrinkage behavior of the rest of the fabric on fabric roll 11. If test fabric 20*a* is too small it may by difficult to measure the shrinkage percentage accurately, and the piece may also present some aberrant shrinkage results.

Next, at step 302 the shrinkage results 22 (22*l* and 22*w*) are modified into working shrinkage results 30 by working shrinkage results calculator before the process continues. Working shrinkage results 30 are used to account for the additional material shrinkage when additional material is added to garment specification 12. For example, when test fabric 20*a* is shrunk in bulk wash conditions a shrinkage result 22 is obtained. However, when the actual fabric is enlarged to account for the fabric shrinkage, a small amount additional fabric, or the shrinkage fabric 40, is added in excess of garment specification 12. Just as the amount of original fabric shrinks, the additional fabric added to the garment also shrinks. To compensate for the shrinkage of shrinkage amount 40, raw shrinkage results 22 are modified by working shrinkage result calculator 19 into working shrinkage results 30 using the equation:

$$100((1+x)+(x+x/100))-100/100$$

where x=either length or width shrinkage results 22*l* or 22*w*

This produces working shrinkage results 30 by adding an additional percentage equal to the original shrinkage results 22.

For example as illustrated in FIG. 8, length shrinkage result 22*l* was measured at 8.33%, entered at step 300. This number was modified into 9.02389% or working shrinkage result 30*l*, by using the above equation at step 302. Here 8.33% of 8.33% is 0.693889%, which when added to 8.33% yields 9.02389%. This enlarged working shrinkage result 30 will account for the shrinkage not only of the garment specification 12 but also of the additional several inches fabric needed to create the pattern for enlarged garment specification 14. This assumes that the shrinkage of the extra material will occur at roughly the same percentage as the shrinkage of the majority of the garment piece.

At step 304 a user enters garment specification 12 into garment specification table 32 the contents of which are displayed on printout 27, as illustrated in FIG. 8. The sample garment used in FIG. 8 is a shirt made of a woven material. These numbers represent the final measurements that garment 18 must conform to within acceptable tolerance. The numbers listed on garment specification table 32 in FIG. 8 are in inches.

Next, at step 306 the user picks a formula 34 from system 24, as stored in formula table 15 based on several factors that can effect the shrinkage of garment 18. Examples of these factors include but are not limited to knit fabrics versus woven fabrics, pattern cut direction with respect to the fabric roll direction, stretch properties of the style of garment, bulk washing formulas, and other features of the garment such as pockets which affect shrinkage during bulk washing. A more detailed description of some of the possible formulas 34 for system 24, detailing their particular uses is discussed below.

Regarding bulk wash conditions, FIGS. 20 and 21 illustrates a bulk wash formula table. Using such a table the user can determine based on the wash duration, wash temperature, fabric construction, fabric weight, fabric finish, and type of wash if any modifications to formula 34 are required. For example, longer or more intense washes tend to breakdown a fabrics ability to resist shrinkage, whereas lighter shorter washes will allow the fabric to retain its strength and its ability to resist shrinkage.

Regarding pockets, FIG. 22 illustrates a sample chart which shows the modification amounts to shrinkage calculations that for pants based on the number of pockets. Additional stitching from the pockets adds resistance to shrinkage. However, as the fabric is washed longer or under harsh conditions, this resistance is broken down. As such, FIG. 22 illustrates this, in that additional material is added to the waistband of the pants in larger amounts when there are less pockets, because there is less resistance shrinkage. Similarly, more fabric needs to be added as the bulk wash cycle is lengthened, because the harsher washing conditions also break down the resistance to shrinkage. FIG. 22 is correlated to FIGS. 20 and 21 in that the numbers on the left column, 2–5, 6–9, 10–13 and 14–17 are derived based on the bulk wash formula calculation found on the right column in FIGS. 20 and 21.

These criteria for assisting in selection of formula 34 are intended only as examples of possible calculations used to select formula 34 and are in no way intended to limit the scope of the present invention. Any such assessment of a fabric shrinkage factor used to help select the correct formula 34 for use in system 24 is within the contemplation of the present invention.

Formula 34 can be created in one of several ways. One example for the base formula used for formulas 34*a*–34*e* as stored in formula table are referred to as 15 "Master woven shirt formula #1–#5 w/body at X %–Y % breakdown of 100% shrinkage w/collar and band at Z %." Here X % represents the percent shrinkage in the armhole and Y % the remaining shrinkage percentage, which adds up to 100% shrinkage attributable to the remaining height of the back.

The Z % shrinkage is the shrinkage percentage out of 100% that in the collar and band will experience. For example, if the overall shrinkage percentage is 10%, then Z % represents the percentage of that 10% overall shrinkage that will be displayed by the collar and the band. This Z % is separate from the calculations associated with the X % and the Y %.

These percentages relate to modifications to working shrinkage results 30*l* and 30*w* based on modifications to raw shrinkage results 22 from test fabric 20*a*. The results obtained from test fabrics 20 do not necessary reflect the actual shrinkage that the various elements of garment 18 will experience during the bulk washing. Test fabric 20*a* is a flat unstitched piece of fabric, however the various pieces of garment 18 such as the collar, waist cuff, front and the back, include snitchings and stretching factors (from bulk wash process) that may reduce the shrinkage. Therefore, system 24 uses formulas 34 and their associated modification percentages 36 stored in formula table 15 to create working shrinkage results 30.

One example of formula 34*a*, is "Master woven shirt formula #1 w/body at 60%–40% Breakdown of 100% shrinkage w/collar and band at 60%." Formula 34*a* is used here as an example for illustrating the complete operation of system 24, however any one of a list of programs can be chosen at step 306 depending on the intended garment style, fabric to be used, and bulk wash specifications. The 60%+40% breakdown of 100% represent the principal modification percentages 36 for length (60%) and width (40%). Also, the collar and band measurements are adjusted by 60% in formula 34*a*. However, because some of the measurements used in garment specification 12 incorporate measurements along both the length and width axes, the actual modification percentages 36 for the various pieces of garment 18 range from 50% to 100%. As illustrated in FIG. 8, the various modification percentages 36 used for each garment piece is listed beside that piece in modification percentage column 38 of print out 25, as populated by formula table 15 based on the formula 34 chosen. When selecting a formula 34 from formula table 15, the user bases the decision on their own knowledge and experience as well as some general guidelines discussed below. If the wrong formula 34 is chosen then garment 18 will not meet the requirements of garment specification 12. This could be one of the reasons described above at steps 108 and 110 where the user may have to adjust system 24 to achieve acceptable results. At step 308 the user selects formula 34*a* from formula table 15 of system 24 which in turn instructs before-wash processor 25 of the appropriate modification percentage 36. These modification percentages also populates modification percentage column 38 in print out 25, as illustrated on FIG. 8. Next, at step 310 before-wash processor 25 of system 24 calculates enlarged garment specification 14 by using working shrinkage result 30 percentage, modifying it with the appropriate modification percentage 36 and applying it to garment specification 12 for each piece of garment 18 such as, the top collar, chest, and waist etc. This results in a shrinkage amount 40, which in turn populates shrinkage amount table 42.

When calculating shrinkage amount 40, working shrinkage results 30 are multiplied by modification percentages 36. However, there are two sets of working shrinkage results, 30*w* and 30*l*. A shrinkage results orientation table 39, populated with data retrieved from formula table 15, identifies which of the working shrinkage results 30*l* or 30 *w* is necessary for each particular garment 18 piece. Shrinkage results orientation table 39 lists either an L or a W or both next to each garment 18 piece. The contents of shrinkage results orientation table 39 are displayed on printout 27 next to each piece of garment 18. Based on this information, system 24 will use the proper working shrinkage results 30*l* or 30*w* when multiplying by modification percentages 36. As explained above the orientation of the fabric off of fabric roll 11, is the determining factor in which working shrinkage result 30 from test fabric 20*a* is for the length and which is for the width. When garment specification 12 is given to the manufacturer the pattern must be matched against the justified against fabric roll 11 orientation After, shrinkage amount 40 is calculated by before-was processor 25 of system 24, it is added to garment specification 12 resulting in enlarged garment specification 14, and stored as output in enlarged garment specification table 44. Print out 25 displays the results found in enlarged garment specification table 44 nest to each piece of garment 18, as illustrated in FIG. 8. These calculations are performed in accordance with the following equation:

$$((X\% \times Y\%) \times Sg) + Sg = ESg$$

where X=working shrinkage results, Y=modification percentage 36, Sg=garment specification (in inches as depicted on FIG. 8), and ESg=enlarged garment specification 14.

This process is repeated for every measurement necessary for garment 18 until all of the pieces are accounted for. For formula 34*a* these measurements include; top collar, collarband, chest, waist, bottom, shoulder, arm hole, body length, side seam, net sleeve, sleeve length combined, cuff width, cuff height, sleeve placket, sh sleeve length sh sleeve hemispherical circumference, collar point length, tie space, and cf placket width. The results are use to populate enlarged garment specification table 44, which, when viewed in printout 27, provides the user with all of the information necessary to produce a final garment 18.

In one embodiment of the present invention, a sample calculation performed by before wash processor 25 for the collar in formula 36*a* (master woven shirt #1) is described using the following:

Master woven shirt #1—collar shrinkage results (22*l*)—8.33%; working shrinkage results (30*l*)—9.02389% garment specification (12) 16.00"

modification percentage (36) 60% shrinkage amount (40)=60%×9.02389%×16.00"=0.86629"

enlarged garment specification (14)=16.00"+0.87"=16.87"

More complicated calculations occur when the particular piece of garment 18 being modified included measurements along both the length and width axes. Such calculations occur in situations such as the armhole and sleeve length modifications, as illustrated by shrinkage result orientation table 39 on printout 27 as seen in FIG. 8.

These calculations include the use of both working shrinkage results 30*l* and 30*w*. The calculation for the armhole in this cases uses both working shrinkage results 30*l* and 30*w* to calculate the appropriate enlarged garment specification 14.

Before-wash processor 25, using a combination fraction 48, in conjunction with the equation listed above the armhole calculation, utilizes the following modified equation $$Sg+(Sg(Zw)(Xw\ \%)(Y\ \%))+(Sg(Zl)(Xl\ \%)(Y\ \%))$$

where Xw=working shrinkage results (width), Xl=working shrinkage results (length), Y=modification percentage, Zw=combination fraction (width), Zl=combination fraction (length), Sg=garment specification (in inches as depicted on FIG. 8), and ESg=enlarged garment specification.

In an exemplary calculation of the armhole shrinkage amount 40 and enlarged garment specification 14, the calculations are as follows:

Master woven shirt #1—armhole shrinkage results (22*l*)—8.33%; working shrinkage results (30*l*)—9.02389% shrinkage results (22*w*)—3.12%; working shrinkage results (30*l*)—3.21734% garment specification (12) 22.88"

modification percentage (36) 60% combination fraction (48*w*)—7/12 combination fraction (48*l*)—17/30

Enlarged garment specification (14)=22.88"+[(22.88" 7/12)(3.21734%)(60%)]+[(22.88 17/30)(9.02389%)(60%)]=22.88"+0.2576+0.7187=23.85"

As illustrated in this calculation, enlarged garment specification 14 is calculated using both working shrinkage results 30*l* and 30*w*. Combination fractions 48*l* and 48*w* are derived from the ratio of length fabric to width fabric used in a particular garment piece measurement, the armhole in this case, and then modifying it for overlap. Combination fractions 48 are stored in formula table 15, and sent to before wash processor 25 along with the accompanying modification percentages 36. As is illustrated in formula 34*a*, armhole measurement, the combination fractions 48*l* and 48*w* exceed 1.0 (13/20) which implies that some of the length and width shrinkages will overlap slightly at the meeting point for these measurements.

Also illustrated in FIG. 8 the sleeve measurement requires both length and width measurements as well, however, system 24 does not directly utilize working shrinkage results 30*w* and 30*l* but instead uses shrinkage amount 40, as stored in shrinkage amount table 42, from two other garment pieces, the shoulder (which uses 30*w*) and the net sleeve (which uses 30*w*).

Different formulas 34 can be used by system 24 which employ many different equations to calculate enlarged garment specification 14 from garment specification 12. The above listed example was only an example of one formula 34 for using with system 24, however many different formulas 44 are available, which are described in more detail below. Additionally, any system that utilizes similar calculations to account from bulk wash shrinkage are within the contemplation of the present invention. Different garment 18 types, different cut styles and different bulk wash formulas may employ several variations to the standard equations used.

Derivations of Shrinkage Percentages 36 for Formula 34*a*–34*l*

In another embodiment of the present invention, various formulas 34*a*–34*l* exist for use with system 24 for use with different fabric types or different garment types to account for the differences in modification percentages 36 necessary to adjust working shrinkage results 30. As discussed above, such factors as the variations in the stitching of garment pieces such as the collar and cuffs, stretch properties of the fabric, bulk wash formulas used and the use of long or short sleeves, give rise to the need for formulas 34*a*–34*l* to utilize different modification percentages 36 Formulas 34*a* 34*l* listed below are only samples of formulas 34 that can be used in conjunction with this program.

In this embodiment, an exemplary discussion of the origin of some of shrinkage percentages 36 for formulas 34*a*–34*l* follows. These formulas 34*a*–34*l* are intended as examples of shrinkage percentages 36 as used on certain types of garments 18 and is no way intended to limit the scope of the present invention. Any system 24 which incorporates the use of estimated shrinkage percentages 36, to modify garment specifications 12 as described above is within the contemplation of this invention Woven Shirt Shrinkage Formulas 34*a*–34*e*

In one embodiment of the present invention, as illustrated in FIGS. 8–12, formulas 34*a*–34*e* have the following base formula; Master woven shirt formula #1–#5 w/body at X %–Y % breakdown of 100% shrinkage w/collar and band at Z %", where X % and Y % represent shrinkage modification percentages related to the back cut of the shirt at the armhole and along the rest of the length measurement of the back below the armhole, respectively, and the Z % shrinkage is the shrinkage percentage out of 100% that in the collar and band will experience.

Formula 34*a*, entitled "Master woven shirt formula #1 w/body at 60%+40% breakdown of 100% shrinkage, w/collar and band at 60%" is used mostly for higher count fabrics with the collar lining on straight and collarband on a 9 degree bias, where bias refers to the cut angle of the lining pads. Formula 34*b*, entitled "Master woven shirt formula #1 w/body at 60%+40% breakdown of 100% shrinkage, w/collar and band at 65%" is used for mostly the same purpose as formula 34*a* except that 5% of sew shrinkage is added to the collar and the collarband to be used as desired. This adjustment to the collar band is to account for the bias lining cut variations.

Formula 34*c*, entitled "Master woven shirt formula #1 w/body at 60%+40% breakdown of 100% shrinkage, w/collar and band at 70%", is used for the same fabrics that formulas 34*a* and 34*b* are used except that the collar and the collarband use 70% of working shrinkage results 30*l*, because when the lining of the collar and the collarband are at a 45 degree bias they will shrink more due to less resistance to shrinkage. Formula 34*d*, entitled "Master woven shirt formula #1 w/body at 60%+40% breakdown of 100% shrinkage, w/collar and band at 75%" is used in the same situation as formula 34*c* except that there is 5% more allowance for shrinkage in the collar and collar band. Formula 34*e*, entitled "Master woven shirt formula #1 w/body at 70%+30% breakdown of 100% shrinkage, w/collar and band at 70%", is used when the fabric has less resistance to shrinkage. This formula 34*e* also has a 75% allowance for bias lining in the collar and the collarband.

Additionally, woven shirt formulas 34*a*–34*e* allow for alterations of the front armholes at the shoulder seams to match the different percentages of growth in the yoke shoulder seams. These formulas 34*a*–34*e* also allow for alterations of the top of the back armholes so that the top of the backs will match the yoke lengths.

Knit Tops Shrinkage Formula 34*f*–34*j*

In one embodiment of the present invention, as illustrated in FIGS. 13–17, formulas 34*f*–34*j* have the following base formula; Master knit formula #1–3,5–6 W–A %, L–B %, SL–C %, using D %–E % breakdown or 100% shrinkage. Here A %, B % and C % refer to the overall shrinkage amounts along three separate measurements, length, width, and sleeve length and where D % and E % represent the percent of overall shrinkage along the length of the back at the armhole and along the remaining length of the back, respectively. The A %, B % and C % show that the knit formulas, when stitched may display additional restraint in overall shrinkage along the width and the sleeve length due to properties inherent in the knit fabrics and reaction to tumbling in the bulk wash.

Formula 34*f*, entitled "Master knit formula #1 W–100%, L–100%, SL–100%, using 80%+20% breakdown or 100% shrinkage" is used in standard knit shirts which do not display much resistance to shrinkage. The 80% (D %)+20% (E %) is the formula breakdown of 100% shrinkage corresponding to the shrinkage percentage 36 used in body area.

The remaining formulas; 34*g* entitled "Master knit formula #2 W–100%, L–100%, SL–95%, using 80%+20% breakdown or 100% shrinkage"; 34*h* entitled "Master knit formula #3 W–100%, L–100%, SL–90%, using 80%+20% breakdown or 100% shrinkage"; 34*i* entitled "Master knit formula #5 W–100%, L–100%, SL–75%, using 80%+20% breakdown or 100% shrinkage"; and 34*j* entitled "Master knit formula #6 W–100%, L–100%, SL–60%, using 80%+20% breakdown or 100% shrinkage" represent variations pertaining to the stretching qualities and shrinkage resistance qualities found in garments 18 sleeve lengths due to shrinkage resistance caused by the stitching.

Pants Shrinkage Formulas 34*k* and 34*l*

Figure 18A:
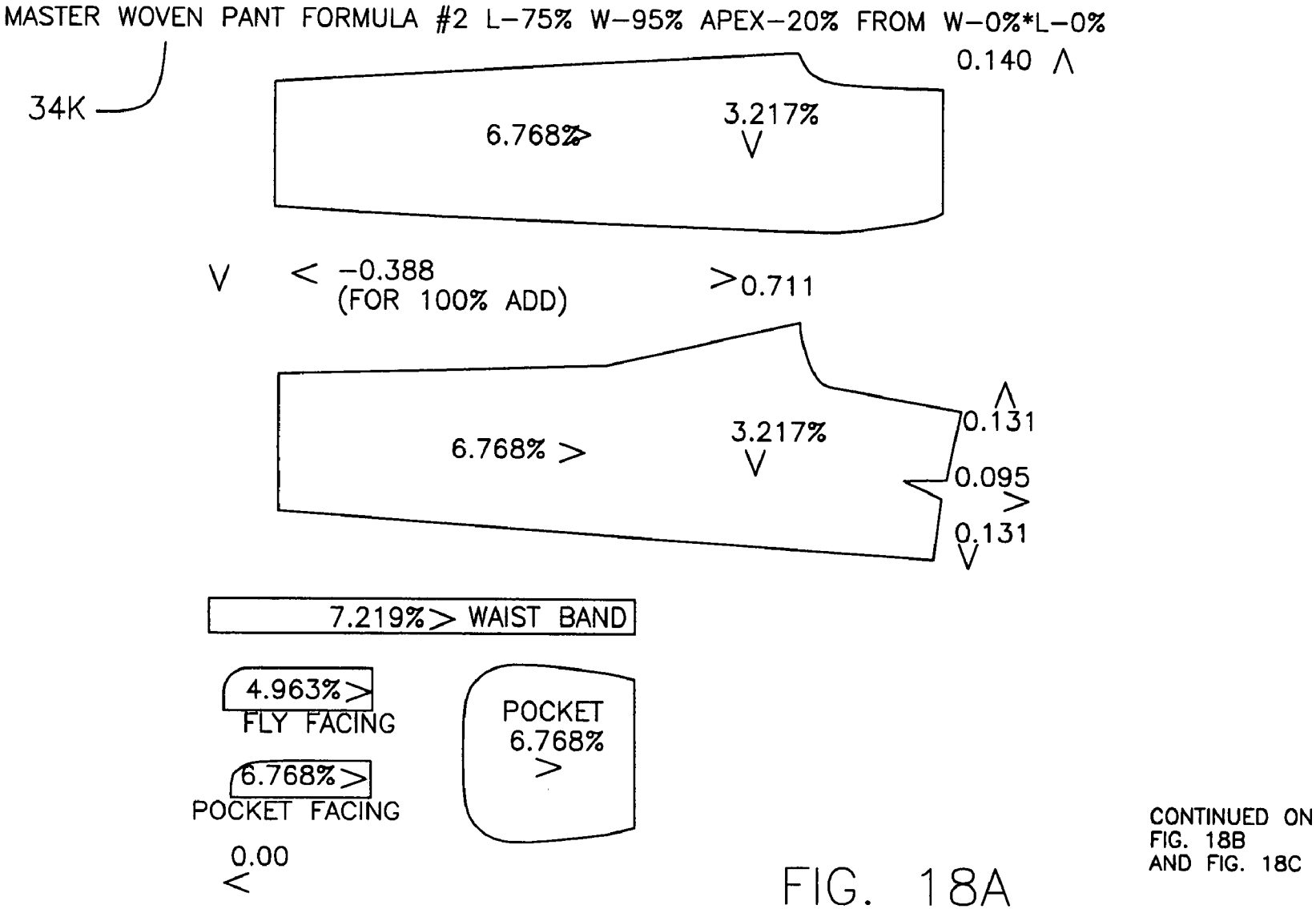
Figure 19A:
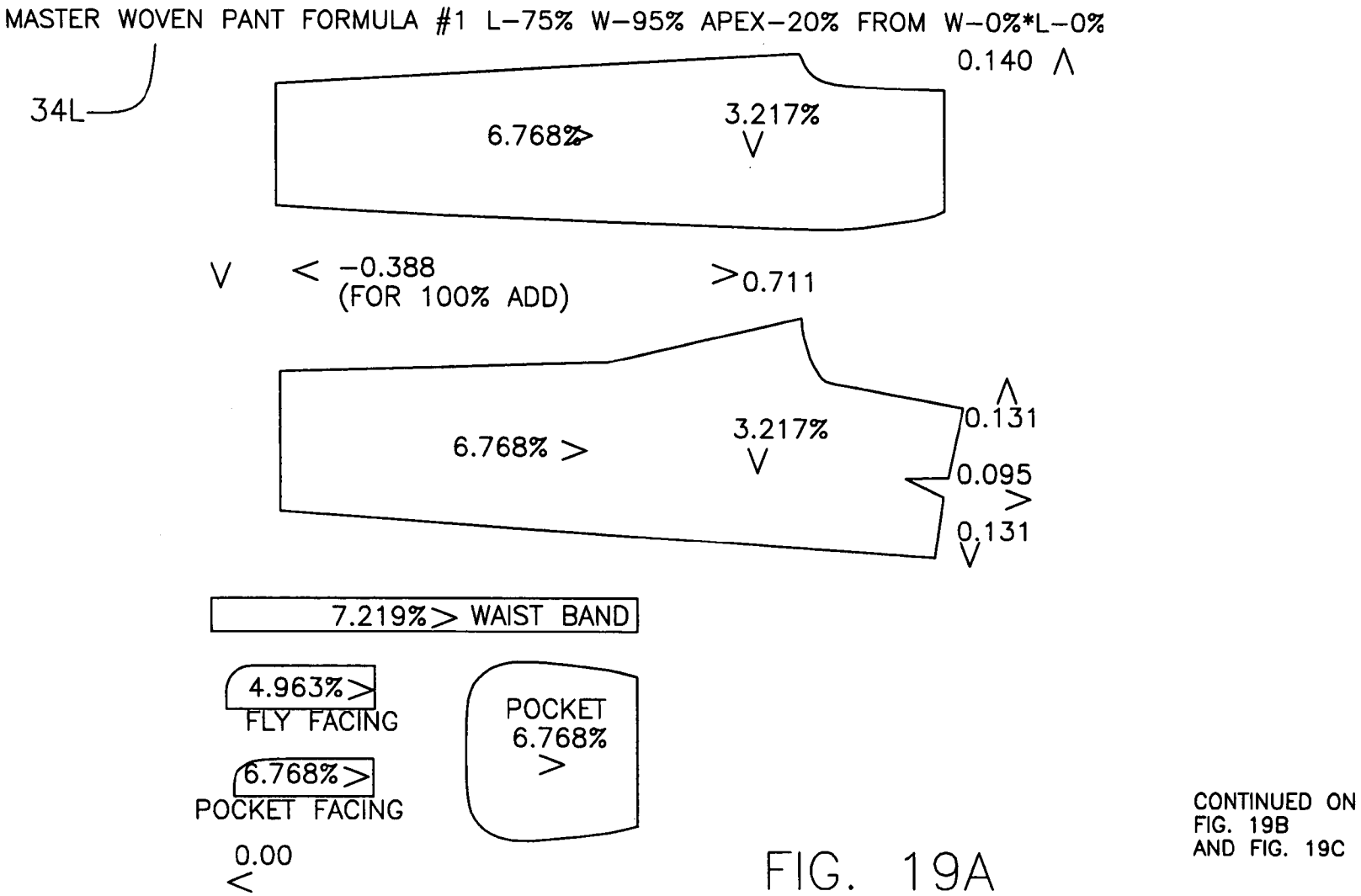

In one embodiment of the present invention, as illustrated in FIGS. 18 and 19, formulas 34*k* and 34*l* have the basic formula "Master woven pant formula#1–2 L–A %, W–B %, Apex–C % from W–0%*L–0%" where A %, B % refer to the width and length shrinkage adjustments used for modification percentages 36. C % refers to the apex shrinkage adjustment used for modification percentage 36 that include measurements near the seat of the pants. The terms "From W–0%*L–0%" simply means that the A %, B % and C % are applied directly to the garment specifications 12.

Formula 34*k*, entitled "Master woven pant formula#2 L–75%, W–100%, Apex–20% from W–0%*L–0%", the first 75% is length modification percentage 36 for the front and back body lengths. The 100% corresponds to shrinkage percentage 36 for the front and back body patterns, and the 20% shrinkage percentage 36 corresponds to the amount that the crotch is raised to achieve a 55% extension for the front rise because the zipper will resist further shrinkage.

Here the back crotch is being raised with front crotch but it is blended to back rise line. The raising of the crotch by a shrinkage percentage 36 of 20% also increases the inseam length shrinkage allowance to 95%. However, the side seam shrinkage percentage 36 remains 75%.

Additionally, in order to be able to set waistband to the pant, formula 34*k* provides for an alteration at top of fly, top of back rise & top of back rise seam. These alterations will match the waist measurements of the body width to the length measurements of the waistband allowing forr stretch while setting. If fabric has a lot of width stretch, formula 34*k* could be changed to allow more stretch of waistband while setting.

Formula 34*l*, entitled "Master woven pant formula#l L–75%, W–95%, Apex–20% from W–0%*L–0%" is used when the width of the fabric has more stretch quality than normal.

While only certain features of the invention have been illustrated and described herein, many modifications, substitutions, changes or equivalents will now occur to those skilled in the art. It is therefore, to be understood that this application is intended to cover all such modifications and changes that fall within the true spirit of the invention.

What is claimed is:

1. A computer readable medium including instructions for a method for adjusting fabric shrinkage from a bulk wash process, said method comprising the steps of:

storing a plurality of sets of modification percentages;

selecting one of said plurality of sets of modification percentages corresponding to the garment to be created;

entering a garment specification corresponding to the desired measurements for said garment;

entering shrinkage results obtained from a test fabric;

calculating a shrinkage amount using said shrinkage results and said modification percentage set; and modifying said garment specification into an enlarged garment specification by adding said shrinkage amount to said garment specification.

2. A method as claimed in claim 1, wherein said modification percentage set is chosen based on the type of fabric, corresponding to an expected shrinkage.

3. A method as claimed in claim 1, wherein said shrinkage results are obtained from a test fabric taken from the same fabric role as said garment.

4. A method as claimed in claim 1, further comprising the step of converting said shrinkage results into working shrinkage results to compensate for the additional fabric used in said garment when produced according to said enlarged garment specification.

5. A method as claimed in claim 1, wherein said conversion of said shrinkage results into said working shrinkage results utilizing the equation $$100((1+x)+(x+x/100))-100/100$$

where x=either length or width shrinkage results.

6. A method as claimed in claim 1, wherein said modification percentages are used so as to adjust the shrinkage results to compensate for properties of the fabric and stitching of said garment that may reduce the shrinkage, including bias seams and stretching properties.

7. A method as claimed in claim 1, wherein said modification of garment specification into said enlarged garment specification for an element of said garment that uses only a single shrinkage result direction is calculated utilizing the equation $$((X\%\times Y\%)\times Sg)+Sg=ESg$$

where X=working shrinkage result, Y=modification percentage, Sg=garment specification, and ESg=enlarged garment specification.

8. A method as claimed in claim 1, where in said modification of garment specification into said enlarged garment specification for an element of said garment that uses both length and width shrinkage result direction is calculated utilizing the equation $$Esg=Sg+(Sg(Zw)(Xw\%)(Y\%))+(Sg(Zl)(Xl\%)(Y\%))$$

where Xw=working shrinkage result for width, Xl=working shrinkage result for length, Y=modification percentage, Zw=combination fraction for width, Zl=combination fraction for length, Sg=garment specification, and ESg=enlarged garment specification.

* * * * *